US011332959B2

(12) United States Patent
Hollermann et al.

(10) Patent No.: US 11,332,959 B2
(45) Date of Patent: May 17, 2022

(54) FENESTRATION ASSEMBLY OPERATION HARDWARE AND METHODS FOR SAME

(71) Applicant: Marvin Lumber and Cedar Company, LLC, Warroad, MN (US)

(72) Inventors: Ross Michael Hollermann, Salol, MN (US); Nathan H. DeBoer, Salol, MN (US); Daniel Jon Curtis, Warroad, MN (US)

(73) Assignee: Marvin Lumber and Cedar Company, LLC, Eagan, MN (US)

( * ) Notice: Subject to any disclaimer, the term of this patent is extended or adjusted under 35 U.S.C. 154(b) by 956 days.

(21) Appl. No.: 15/873,707

(22) Filed: Jan. 17, 2018

(65) Prior Publication Data

US 2018/0202198 A1 Jul. 19, 2018

Related U.S. Application Data

(60) Provisional application No. 62/447,295, filed on Jan. 17, 2017.

(51) Int. Cl.
*E05B 65/08* (2006.01)
*E05C 1/08* (2006.01)
(Continued)

(52) U.S. Cl.
CPC ..... *E05B 65/0829* (2013.01); *E05B 15/006* (2013.01); *E05B 15/0205* (2013.01);
(Continued)

(58) Field of Classification Search
CPC ..... E05B 65/0829; E05B 65/0864; E05B 65/087; E05B 65/0882; E05B 15/006;
(Continued)

(56) References Cited

U.S. PATENT DOCUMENTS 398,039 A 2/1889 Flatman et al.
660,438 A 10/1900 Holly et al.
(Continued)

FOREIGN PATENT DOCUMENTS

GB 2333555 7/1999
WO 2006116675 11/2006

OTHER PUBLICATIONS

US 9,523,223 B2, 12/2016, DeBoer et al. (withdrawn)
(Continued)

*Primary Examiner* — Alyson M Merlino
(74) *Attorney, Agent, or Firm* — Schwegman Lundberg & Woessner, P.A.

(57) ABSTRACT

A fenestration hardware assembly includes a blade socket including a blade recess and an operator interface feature rotatably coupled with an operator housing. A latch blade is movably coupled with the operator housing. The latch blade is movable between deployed and withdrawn positions. In the deployed position at least a portion of the latch blade is received in the blade recess of the blade socket. In the withdrawn position the portion of the latch blade is recessed from the blade recess. The operator interface feature is rotatable between at least locked and unlocked configurations. In the locked configuration the latch blade is in the deployed position and received in the blade recess. In the unlocked configuration the latch blade is translated from the deployed position to the withdrawn position and withdrawn from the blade recess according to rotation of the operator interface feature.

36 Claims, 17 Drawing Sheets

(51) Int. Cl.

| | |
|---|---|
| ***E05B 63/24*** | (2006.01) |
| ***E05C 1/12*** | (2006.01) |
| ***E05C 9/00*** | (2006.01) |
| ***E05C 7/00*** | (2006.01) |
| ***E05B 63/20*** | (2006.01) |
| ***E05B 15/00*** | (2006.01) |
| ***E05C 1/10*** | (2006.01) |
| ***E05B 15/02*** | (2006.01) |
| ***E05B 53/00*** | (2006.01) |

(52) U.S. Cl.
CPC ..... *E05B 53/003* (2013.01); *E05B 63/244* (2013.01); *E05C 1/085* (2013.01); *E05C 1/10* (2013.01); *E05C 1/12* (2013.01); *E05C 9/00* (2013.01); *E05B 15/022* (2013.01); *E05B 63/20* (2013.01); *E05B 65/087* (2013.01); *E05B 65/0864* (2013.01); *E05C 2007/007* (2013.01)

(58) Field of Classification Search
CPC ..... E05B 15/0205; E05B 15/022; E05B 15/0053; E05B 53/003; E05B 63/244; E05B 63/20; Y10T 292/0834; Y10T 292/0837; Y10T 292/0841; Y10T 292/084; Y10T 292/0844; Y10T 292/102; Y10T 292/0971; Y10T 292/098; Y10T 292/0982; Y10T 292/0985; Y10T 292/0987; Y10T 292/0994; Y10T 292/1016; Y10T 292/54; Y10T 292/546; Y10T 292/558; Y10S 292/20; Y10S 292/25; Y10S 292/35; Y10S 292/47; E05C 1/085; E05C 1/10; E05C 1/12; E05C 1/16; E05C 9/00; E05C 9/04; E05C 2007/007
See application file for complete search history.

(56) References Cited

U.S. PATENT DOCUMENTS

| | | | | |
|---|---|---|---|---|
| 937,348 | A * | 10/1909 | Wheelock | E05C 1/10 292/175 |
| 1,434,371 | A | 11/1922 | Crompton et al. | |
| 2,104,134 | A | 1/1938 | Ferdinand | |
| 2,274,711 | A | 3/1942 | Krause | |
| 2,545,645 | A | 3/1951 | Blakely | |
| 2,778,326 | A | 1/1957 | Guzik | |
| 2,883,225 | A | 4/1959 | Akehurst | |
| 2,967,595 | A | 1/1961 | Abe | |
| 3,525,830 | A | 8/1970 | Hawkins | |
| 3,641,540 | A | 2/1972 | Cutler et al. | |
| 4,346,372 | A | 8/1982 | Sandberg | |
| 4,351,288 | A | 9/1982 | Gasloli | |
| 4,465,997 | A | 8/1984 | Hines | |
| 4,497,135 | A | 2/1985 | Vetter | |
| 4,624,073 | A | 11/1986 | Randall | |
| 4,639,021 | A | 1/1987 | Hope | |
| 5,004,961 | A | 4/1991 | Berner et al. | |
| 5,006,766 | A | 4/1991 | Yuhas et al. | |
| 5,090,750 | A | 2/1992 | Lindqvist | |
| 5,226,256 | A | 7/1993 | Fries et al. | |
| 5,301,989 | A | 4/1994 | Dallmann et al. | |
| 5,311,168 | A | 5/1994 | Pease, Jr. et al. | |
| 5,355,059 | A | 10/1994 | McMillan | |
| 5,382,060 | A | 1/1995 | O'Toole et al. | |
| 5,398,447 | A | 3/1995 | Morse | |
| 5,437,173 | A | 8/1995 | Spinar | |
| 5,449,987 | A | 9/1995 | McMillan | |
| 5,592,781 | A | 1/1997 | Mauro | |
| 5,595,075 | A | 1/1997 | Chen | |
| 5,595,409 | A | 1/1997 | Fier et al. | |
| 5,653,485 | A | 8/1997 | Campbell | |
| 5,712,621 | A | 1/1998 | Andersen | |
| 5,791,700 | A | 8/1998 | Biro | |
| 5,992,907 | A | 11/1999 | Sheldon et al. | |
| 6,141,913 | A | 11/2000 | Wong et al. | |
| 6,176,041 | B1 | 1/2001 | Roberts | |
| 6,212,923 | B1 | 4/2001 | Clark | |
| 6,588,150 | B1 | 7/2003 | Wong et al. | |
| 6,615,629 | B2 | 9/2003 | Bates | |
| 6,669,242 | B2 | 12/2003 | Fountaine et al. | |
| 6,672,009 | B1 | 1/2004 | Wong et al. | |
| 6,778,086 | B2 | 8/2004 | Morrone et al. | |
| 6,817,142 | B2 | 11/2004 | Marshik et al. | |
| 6,871,885 | B2 | 3/2005 | Goldenberg et al. | |
| 6,877,784 | B2 | 4/2005 | Kelley et al. | |
| 6,938,373 | B2 | 9/2005 | Wong et al. | |
| 6,957,513 | B2 | 10/2005 | Pettit et al. | |
| 7,013,603 | B2 | 3/2006 | Eenigenburg et al. | |
| 7,042,353 | B2 | 5/2006 | Stilp | |
| 7,068,162 | B2 | 6/2006 | Maple et al. | |
| 7,070,215 | B2 | 7/2006 | Kelley et al. | |
| 7,079,020 | B2 | 7/2006 | Stilp | |
| 7,118,142 | B2 | 10/2006 | Xu | |
| 7,158,029 | B1 | 1/2007 | Martyn | |
| 7,165,791 | B2 | 1/2007 | Rebel et al. | |
| 7,227,463 | B2 | 6/2007 | Merrell | |
| 7,322,619 | B2 | 1/2008 | Nolte et al. | |
| 7,355,515 | B2 | 4/2008 | Lee et al. | |
| 7,407,199 | B2 | 8/2008 | Richardson | |
| 7,412,800 | B2 | 8/2008 | Maier | |
| 7,481,470 | B2 | 1/2009 | Eenigenburg et al. | |
| 7,591,494 | B2 | 9/2009 | Mitchell | |
| 7,607,262 | B2 | 10/2009 | Pettit et al. | |
| 7,731,251 | B2 | 6/2010 | Ye | |
| 7,812,800 | B2 | 10/2010 | Peng et al. | |
| 7,874,598 | B2 | 1/2011 | Chung | |
| 7,963,577 | B2 | 6/2011 | Wolf | |
| 7,976,077 | B2 | 7/2011 | Flory et al. | |
| 8,020,904 | B2 | 9/2011 | Flory et al. | |
| 8,182,001 | B2 | 5/2012 | Tremble et al. | |
| 8,205,920 | B2 | 6/2012 | Flory | |
| 8,269,627 | B2 | 9/2012 | Gore et al. | |
| 8,624,736 | B2 | 1/2014 | Gore et al. | |
| 8,955,255 | B2 | 2/2015 | DeBoer et al. | |
| 8,978,304 | B2 | 3/2015 | Hollermann et al. | |
| 9,157,902 | B2 | 10/2015 | Gore et al. | |
| 9,562,378 | B2 | 2/2017 | DeBoer et al. | |
| 9,657,503 | B2 | 5/2017 | Hollermann et al. | |
| 10,138,658 | B2 * | 11/2018 | Barton | E05B 63/20 |
| 10,228,266 | B1 | 3/2019 | Mcgruder et al. | |
| 10,930,124 | B2 | 2/2021 | Fames et al. | |
| 2002/0116874 | A1 | 8/2002 | Marshik | |
| 2003/0084614 | A1 | 5/2003 | Pettit et al. | |
| 2003/0110698 | A1 | 6/2003 | Polowinczak et al. | |
| 2003/0110699 | A1 | 6/2003 | Eenigenburg et al. | |
| 2004/0003541 | A1 | 1/2004 | Wong et al. | |
| 2004/0001683 | A1 | 9/2004 | Pettit et al. | |
| 2004/0168370 | A1 | 9/2004 | Pettit et al. | |
| 2004/0195843 | A1 | 10/2004 | Rotondi et al. | |
| 2004/0200150 | A1 | 10/2004 | Kelley et al. | |
| 2005/0097823 | A1 | 5/2005 | Marshik | |
| 2005/0140150 | A1 * | 6/2005 | Hall | E05B 63/20 292/336.3 |
| 2006/0033343 | A1 * | 2/2006 | Xu | E05B 63/20 292/139 |
| 2006/0225354 | A1 | 10/2006 | Kelley et al. | |
| 2006/0244270 | A1 | 11/2006 | Rotondi | |
| 2007/0046036 | A1 | 3/2007 | Kinsey | |
| 2007/0194914 | A1 | 8/2007 | Gates | |
| 2007/0209281 | A1 | 9/2007 | Flory et al. | |
| 2007/0262848 | A1 | 11/2007 | Berstis et al. | |
| 2008/0000162 | A1 | 1/2008 | Zayac | |
| 2008/0084299 | A1 | 4/2008 | Fisher et al. | |
| 2008/0129054 | A1 | 6/2008 | Tremble et al. | |
| 2008/0163551 | A1 | 7/2008 | Nolte et al. | |
| 2008/0211238 | A1 * | 9/2008 | Stevens | E05C 19/16 292/163 |
| 2008/0246287 | A1 * | 10/2008 | Satram | E05B 63/20 292/158 |
| 2009/0241429 | A1 | 10/2009 | Polowinczak et al. | |

(56) References Cited

U.S. PATENT DOCUMENTS

| | | | | |
|---|---|---|---|---|
| 2010/0050528 | A1 | 3/2010 | Pettit et al. | |
| 2010/0207403 | A1* | 8/2010 | Bourgoin | E05B 63/20 292/335 |
| 2010/0218425 | A1 | 9/2010 | Nolte et al. | |
| 2010/0263415 | A1 | 10/2010 | Ruspil | |
| 2011/0113695 | A1 | 5/2011 | Derham | |
| 2011/0001920 | A1 | 8/2011 | Barton et al. | |
| 2011/0192089 | A1 | 8/2011 | Barton et al. | |
| 2011/0296880 | A1 | 12/2011 | Sieglaar et al. | |
| 2011/0304163 | A1 | 12/2011 | Liang et al. | |
| 2012/0313386 | A1 | 12/2012 | Liang | |
| 2012/0313387 | A1 | 12/2012 | Liang | |
| 2013/0214545 | A1 | 8/2013 | Wolf | |
| 2013/0283694 | A1 | 10/2013 | Deboer et al. | |
| 2013/0283695 | A1 | 10/2013 | Hollermann et al. | |
| 2013/0285391 | A1 | 10/2013 | Wolf et al. | |
| 2014/0230331 | A1 | 8/2014 | Kellum, III | |
| 2015/0167377 | A1 | 6/2015 | Deboer et al. | |
| 2015/0184434 | A1 | 7/2015 | Hollermann et al. | |
| 2015/0252596 | A1* | 9/2015 | Liang | E05C 1/12 292/163 |
| 2017/0234033 | A1 | 8/2017 | Deboer et al. | |
| 2019/0019382 | A1 | 1/2019 | Fames et al. | |
| 2021/0304572 | A1 | 9/2021 | Farnes et al. | |

OTHER PUBLICATIONS

Definition of the word "cam," https://www.merriam-webster.com/ (Year: 2021).*
Definition of the word "translate," https://www.merriam-webster.com/ (Year: 2021).*
Definition of the word "translation," https://www.merriam-webster.com/ (Year: 2021).*
Definition for "transverse," https://www.merriam-webster.com/dictionary/transverse (Year: 2022).*
U.S. Appl. No. 13/872,842, U.S. Pat. No. 8,955,255, filed Apr. 29, 2013, Double Hung Operation Hardware.
U.S. Appl. No. 14/609,174, U.S. Pat. No. 9,562,378, filed Jan. 29, 2015, Double Hung Operation Hardware.
U.S. Appl. No. 13/872,864, U.S. Pat. No. 8,978,304, filed Apr. 29, 2013, Double Hung Latch and Jamb Hardware.
U.S. Appl. No. 14/658,834, U.S. Pat. No. 9,657,503, filed Mar. 16, 2015, Double Hung Latch and Jamb Hardware.
U.S. Appl. No. 15/430,322, filed Feb. 10, 2017, Integrated Fenestration Status Monitoring System and Methods for the Same.
"U.S. Appl. No. 15/430,322, Non Final Office Action dated Feb. 5, 2019", 9 pgs.
"Kolbe and Kolbe Windows and Doors", [online] [retrieved Apr. 23, 2012]. Retrieved from the Internet: URL: http:www.kolbe-kolbe.com , 1 pg.
"European Application Serial No. 11154029.0, European Search Report and Opinion dated Sep. 25, 2012", 7 pgs.
"U.S. Appl. No. 13/872,842, Restriction Requirement dated Jan. 6, 2014", 9 pgs.
"U.S. Appl. No. 13/872,864, Restriction Requirement dated Feb. 3, 2014", 7 pgs.
"U.S. Appl. No. 13/872,842, Response filed Mar. 6, 2014 to Restriction Requirement dated Jan. 6, 2014", 13 pgs.
"U.S. Appl. No. 13/872,864, Response filed Mar. 26, 2014 to Restriction Requirement dated Feb. 3, 2014", 9 pgs.
"U.S. Appl. No. 13/872,842, Non Final Office Action dated Apr. 11, 2014", 16 pgs.
"U.S. Appl. No. 13/872,864, Non Final Office Action dated May 23, 2014", 14 pgs.
"U.S. Appl. No. 13/872,864, Response filed Aug. 22, 2014 to Non Final Office Action dated May 23, 2014", 14 pgs.
"U.S. Appl. No. 13/872,864, Amendment and Response filed Aug. 22, 2014 to Final Office Action dated May 23, 2014", 14 pgs.
"U.S. Appl. No. 13/872,842, Response filed Sep. 3, 2014 to Non-Final Office Action dated Apr. 11, 2014", 24 pgs.
"U.S. Appl. No. 13/872,842, Examiner Interview Summary dated Aug. 15, 2014", 3 pgs.
"U.S. Appl. No. 13/872,842, Notice of Allowance dated Sep. 29, 2014", 10 pgs.
"U.S. Appl. No. 13/872,864, Notice of Allowance dated Nov. 10, 2014", 10 pgs.
"U.S. Appl. No. 13/872,864, Corrected Notice of Allowance dated Dec. 1, 2014", 2 pgs.
"U.S. Appl. No. 14/609,174, Preliminary Amendment filed Mar. 5, 2015", 8 pgs.
"U.S. Appl. No. 14/658,834, Preliminary Amendment dated Mar. 18, 2015", 7 pgs.
"U.S. Appl. No. 14/609,174, Restriction Requirement mailed U.S. Appl. No. 14/609,174, Restriction Requirement dated Sep. 11, 2015", 9 pgs.
"U.S. Appl. No. 14/609,174, Response filed Nov. 17, 2015 to Restriction Requirement dated Sep. 11, 2015", 9 pgs.
"U.S. Appl. No. 14/609,174, Non Final Office Action dated Dec. 3, 2015", 15 pgs.
"U.S. Appl. No. 14/658,834, Restriction Requirement dated Jan. 21, 2016", 7 pgs.
"U.S. Appl. No. 14/609,174, Response filed Mar. 1, 2016 to Non Final Office Action dated Dec. 3, 2015", 10 pgs.
"U.S. Appl. No. 14/658,834, Response filed Mar. 21, 2016 to Restriction Requirement dated Jan. 21, 2016", 9 pgs.
"U.S. Appl. No. 14/609,174, Applicant Interview Summary filed Apr. 12, 2016", 1 pgs.
"U.S. Appl. No. 14/658,834, Non Final Office Action dated Apr. 20, 2016", 12 pgs.
"U.S. Appl. No. 14/609,174, Notice of Allowance dated May 2, 2016", 12 pgs.
"U.S. Appl. No. 14/609,174, Notice of Allowance dated Aug. 9, 2016", 8 pgs.
"U.S. Appl. No. 14/658,834, Response filed Sep. 12, 2016 to Non Final Office Action dated Apr. 20, 2016", 14 pgs.
"U.S. Appl. No. 14/658,834, Examiner Interview Summary dated Sep. 16, 2016", 3 pgs.
"U.S. Appl. No. 14/658,834, Final Office Action dated Nov. 25, 2016", 11 pgs.
"U.S. Appl. No. 14/658,834, Response filed Dec. 19, 2016 to Final Office Action dated Nov. 25, 2016", 9 pgs.
"U.S. Appl. No. 14/609,174, Corrected Notice of Allowance dated Jan. 5, 2017", 2 pgs.
"U.S. Appl. No. 14/658,834, Notice of Allowance dated Jan. 17, 2017", 5 pgs.
Sopkowiak, J., "Sash Limited Apparatus and Method", U.S. Appl. No. 13/328,776, filed Dec. 16, 2011, 67 pgs.
Sopkowiak, J., "Sash Limiter Apparatus and Method", U.S. Appl. No. 61/486,813, filed May 17, 2011, 63 pgs.
"U.S. Appl. No. 15/430,322, Examiner Interview Summary dated Jun. 5, 2020", 3 pgs.
"U.S. Appl. No. 15/430,322, Examiner Interview Summary dated Jul. 1, 2019", 3 pgs.
"U.S. Appl. No. 15/430,322, Examiner Interview Summary dated Nov. 17, 2020", 3 pgs.
"U.S. Appl. No. 15/430,322, Final Office Action dated Aug. 11, 2020", 14 pgs.
"U.S. Appl. No. 15/430,322, Non Final Office Action dated Jan. 29, 2020", 14 pgs.
"U.S. Appl. No. 15/430,322, Notice of Allowance dated Jul. 31, 2019", 5 pgs.
"U.S. Appl. No. 15/430,322, Notice of Allowance dated Nov. 20, 2020", 5 pgs.
"U.S. Appl. No. 15/430,322, Response filed May 29, 2020 to Non Final Office Action dated Jan. 29, 2020", 23 pgs.
"U.S. Appl. No. 15/430,322, Response filed Nov. 11, 2020 to Final Office Action dated Aug. 11, 2020", 17 pgs.
"U.S. Appl. No. 15/430,322, Response filed Jul. 5, 2019 to Non-Final Office Action dated Feb. 5, 2019", 16 pgs.
"U.S. Appl. No. 15/430,322, Supplemental Notice of Allowability dated Mar. 17, 2021", 2 pgs.
"U.S. Appl. No. 15/430,322, Supplemental Notice of Allowability dated Dec. 11, 2020", 2 pgs.

(56) References Cited

OTHER PUBLICATIONS

"U.S. Appl. No. 16/035,341, Examiner Interview Summary dated Sep. 30, 2020", 3 pgs.
"U.S. Appl. No. 16/035,341, Final Office Action dated Jun. 9, 2020", 19 pgs.
"U.S. Appl. No. 16/035,341, Non Final Office Action dated Oct. 15, 2019", 19 pgs.
"U.S. Appl. No. 16/035,341, Notice of Allowance dated Oct. 21, 2020", 9 pgs.
"U.S. Appl. No. 16/035,341, Response filed Mar. 16, 2020 to Non Final Office Action dated Oct. 15, 2019", 19 pgs.
"U.S. Appl. No. 16/035,341, Response filed Oct. 9, 2020 to Final Office Action dated Jun. 9, 2020", 12 pgs.
"Canadian Application Serial No. 3,001,471, Voluntary Amendment filed Nov. 3, 2020", 9 pgs.
"Canadian Application Serial No. 3,011,471, Office Action dated Dec. 9, 2020", 3 pgs.
"Canadian Application Serial No. 2,992,217, Office Action dated Dec. 8, 2021", 4 pages.
U.S. Appl. No. 16/669,893, filed Oct. 31, 2019, Integrated Fenestration Status Monitoring System and Methods for the Same.
U.S. Appl. No. 16/035,341, U.S. Pat. 10,930,124, filed Jul. 13, 2018, Integrated Fenestration Status Monitoring Systems and Methods for the Same.
U.S. Appl. No. 17/167,815, filed Feb. 4, 2021, Integrated Fenestration Status Monitoring Systems and Methods for the Same.

* cited by examiner

FENESTRATION ASSEMBLY OPERATION HARDWARE AND METHODS FOR SAME

CROSS-REFERENCE TO RELATED PATENT DOCUMENTS

This patent application claims the benefit of priority of Hollermann et al. U.S. Provisional Patent Application Ser. No. 62/447,295 entitled "DOUBLE HUNG OPERATION HARDWARE," filed on Jan. 17, 2017, which is hereby incorporated by reference herein in its entirety.

This patent application is also related to U.S. Application Ser. No. 61/640,525, entitled DOUBLE HUNG OPERATION HARDWARE, and filed Apr. 30, 2012.

This patent application is also related to U.S. Application Ser. No. 61/732,763, entitled DOUBLE HUNG OPERATION HARDWARE, and filed Dec. 3, 2012.

This patent application is also related to U.S. application Ser. No. 13/872,842, entitled DOUBLE HUNG OPERATION HARDWARE, and filed Apr. 29, 2013.

This patent application is also related to U.S. application Ser. No. 14/609,174, entitled DOUBLE HUNG OPERATION HARDWARE, and filed Jan. 29, 2015.

This patent application is also related to U.S. Application Ser. No. 61/640,535, entitled DOUBLE HUNG LATCH AND JAMB HARDWARE, and filed Apr. 30, 2012.

This patent application is also related to U.S. Application Ser. No. 61/790,192, entitled DOUBLE HUNG LATCH AND JAMB HARDWARE, and filed Mar. 15, 2013.

This patent application is also related to U.S. application Ser. No. 13/872,864, entitled DOUBLE HUNG LATCH AND JAMB HARDWARE, and filed Apr. 29, 2013.

This patent application is also related to U.S. application Ser. No. 14/658,834, entitled DOUBLE HUNG LATCH AND JAMB HARDWARE, and filed Mar. 16, 2015.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company, d/b/a Marvin Windows and Doors; Warroad, Minn. USA. All Rights Reserved.

TECHNICAL FIELD

This document pertains generally, but not by way of limitation, to fenestration operation hardware.

BACKGROUND

Tilt latches are used with some examples of double hung windows to facilitate the tilting of the window sashes. Tilting of the window sashes allows for cleaning of the interior and exterior of the window sash while the operator is located, for instance, indoors. In at least some examples, tilt latches are actuated by the operator by applying hand pressure to tilt latches that are otherwise biased outwardly into the adjacent jambs. Actuation of the tilt latches allows for tilting of the window sash.

In some examples, the operator must simultaneously actuate each of two tilt latches installed on opposite sides of the window sash to enable tilting of the sash. The tilt latches are individually operated and held in a retracted orientation to permit tilting. In other words, the tilt latches are biased into the projected orientation when released and held there while the sash is tilted out of the frame.

OVERVIEW

The present inventors have recognized, among other things, that a problem to be solved can include eliminating redundant hardware used in separate mechanisms for operating tilt mechanisms and locking and unlocking of sashes for movement within a frame. In an example, the present subject matter can provide a solution to this problem, for instance with an operation hardware assembly that actuates a latch blade to lock and unlock the sashes and actuates latch bolts remotely for tilting within a frame. The operation hardware assembly consolidates tilting and locking/unlocking functions into a single assembly that is actuated with an operator, such as a rotatable handle. Separated mechanisms and independently operated hardware are thereby avoided.

The present inventors have further recognized, that a problem to be solved can include ensuring reliable locking of sashes with fenestration units that are installed out of square and providing reliable opening and closing of the sashes in any combination and locking of the sashes when closed (also in any combination). For instance, a fenestration unit is in some examples unintentionally installed out of square and locking features at the edges of the sashes and along the frame are not aligned and accordingly do not lock the sashes. In other examples, the sashes of a window assembly are unlocked and opened in a specified pattern (e.g., top sash first followed by the bottom sash) to prevent triggering of one or more autolocking features.

In an example, the present subject matter can provide a solution to these problems, for instance with a latch blade provided near the operator (e.g., a lever). The position of the latch blade facilitates the maintenance of the position of the latch blade with a blade recess of the opposed sash even with out of square installations. For instance, with an out of square installation the perimeter components of the fenestration assembly, such as the frame, edges of the sashes or the like experience greater misalignment than the interior components provide along the checkrails. In contrast, the latch blade provided along the check rail (e.g., near an operator such as a lever) is readily maintained in alignment with the corresponding blade recess because out of square variations in position are less pronounced in the interior of the fenestration assembly (e.g., relative to the remote assembly perimeter).

Further still, the operation hardware assembly described herein includes a retention assembly that maintains the latch blade in a withdrawn position (e.g., thereby unlocking the sashes) while the sashes are closed and throughout movement of one or more of the sashes to open positions. The retention assembly is opening neutral, and thereby allows the user to open either or both of the sashes in any order (either of the top sash or bottom sash opened first) without releasing the latch blade from its withdrawn position. Instead, the operation hardware assembly releases the latch blade into the locked configuration (e.g., with the blade deployed and received in a blade recess of the opposed sash) upon closing of both sashes where at least one of the sashes was previously open. Accordingly, the user may readily open either of the sashes with the unlocked fenestration assembly without the risk of triggering relocking of the latch blade.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
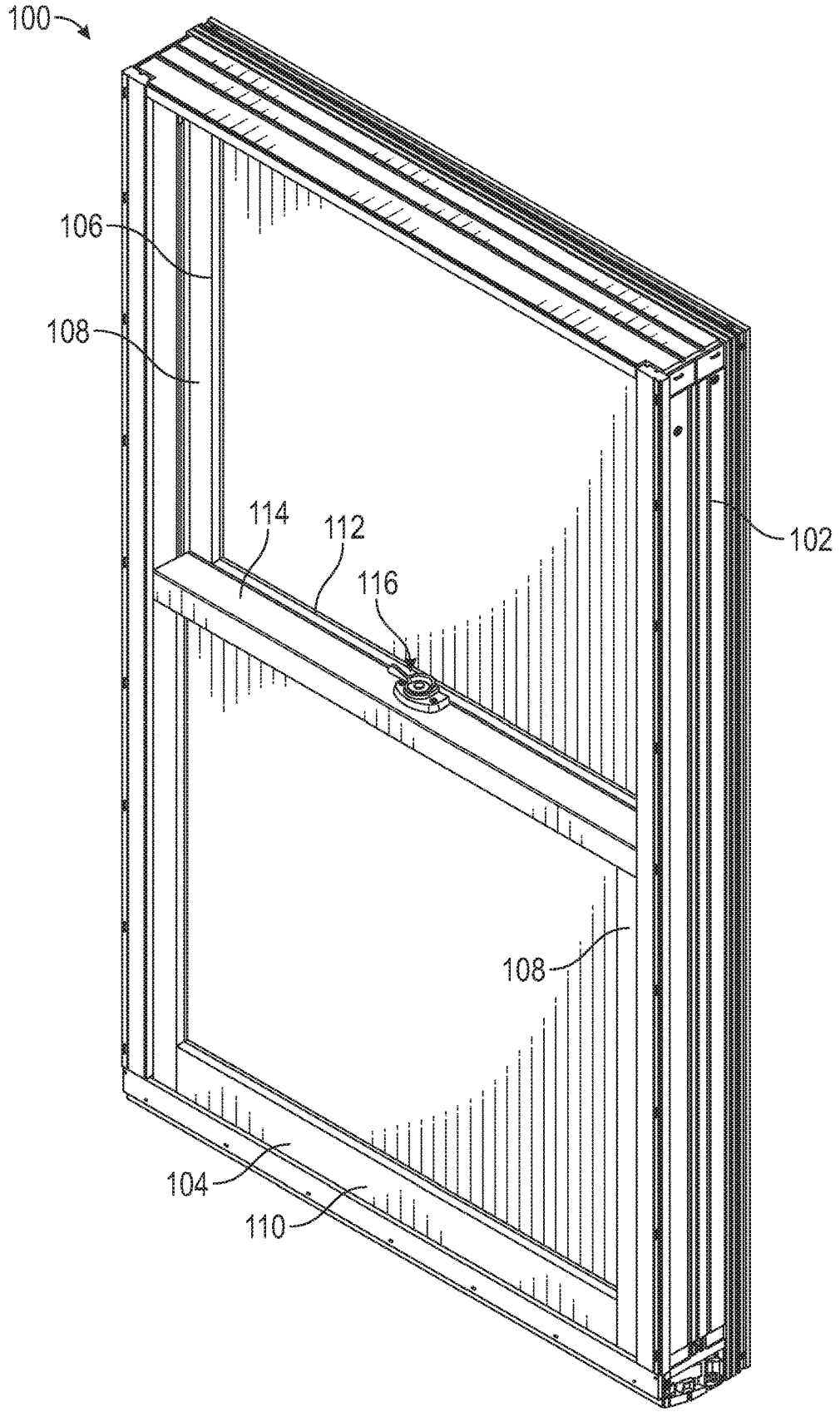
FIG. 1A is a perspective view of one example of a fenestration assembly in a closed configuration.

This hardware systems described herein utilize at least one latch blade that projects orthogonally to the direction of sash travel from a first sash (e.g., bottom) into a strike recess in the second sash (e.g., top). The extension of the latch blade from the bottom sash into the top sash immobilizes both sashes and creates a locked condition. The latch blade includes, but is not limited to, a blade, tongue, plate, bar, post or the like configured to deploy from the first sash for reception in the second sash and thereby lock the first and second sashes. The latch blade provides a distributed member configured for reception within a corresponding opposed recess to institute reliable secure locking of the sashes. Additionally, the latch blade and the blade recess cooperate to ensure reception of the latch blade within the recess even with settling of one or more of the sashes, out of square installations or the like. The latch blade and recess are, in one example, installed toward the interior portion of the sashes where variations due to out of square installations are minimal (in comparison to the perimeter of the assembly), and the latch blade and recess are optionally dimensioned with a taper, enlarged recess or the like, respectively, to promote reception in less than ideal circumstances.

In one example, the latch blade is driven by an eccentric cam coupled with an operator interface feature, such as a lever. The cam is rotated by the operator interface feature to reciprocate the blade between deployed (locked) and withdrawn (unlocked conditions). In another example, the latch blade is biased by a biasing element (e.g., toward the deployed locked condition) and a cam follower of the latch blade (e.g., a slot) is used as a cam to correspondingly rotate the operator interface feature toward the initial locked condition. The operator interface feature coupled with the operation assembly described herein is the point of interaction for the used, and resembles a traditional cam type lock operator.

Further, the fenestration hardware system also configures the fenestration assembly for tilting of at least the bottom sash. A tying element, such as a cord, connects one or more of left or right bottom sash tilt latches. The tying element is routed directly across a spool and between spool legs. In an example, the spool includes the cam described herein. Spool legs on a spool face of the spool engage the tying element (e.g., in a wrapping zone) when the handle is moved to the tilt position (and the spool is moved out of a passive, non-wrapping zone). In the tilt position, a portion of the tying element is wrapped around the spool legs thereby shortening the cord length between the latch bolt assemblies and causing the latch bolts to withdraw from latch bolt recesses of a fenestration frame. With the latch bolts withdrawn the sash is tiltable relative to the fenestration frame.

In another example, the fenestration hardware assembly is configured for automatic locking (e.g., autolocking), that returns the system to a locked condition upon closing of the sashes (in any order). A retaining mechanism within the lock handle assembly restrains the handle in the unlocked position, until the release assembly is activated when both sashes are closed. The release assembly is composed of a moveable trigger surface (e.g., a release element having a release head), that moves perpendicular to the direction of sash travel. The release mechanism further includes a plunger that engages the release element head and a projecting surface configured to engage the opposed sash. As the sashes are closed the plunger interacts with a striker button on the opposed sash (e.g., the top sash). As the sashes are further closed the plunger head is moved with the movement and drives the release element orthogonally relative to the direction of sash travel. The detent of the detent element is unseated from one or more detent notches of the operator interface feature and the interface feature and the latch blade are freed to return to the locked configuration (e.g., with the lever moving to the locked position and the latch blade moving to the deployed position). Because this function is triggered with closing of the sashes the deployed latch blade is automatically received within the blade recess of the blade socket and the sashes are accordingly locked while closed.

The example fenestration hardware assemblies described herein are improvements over conventional cam type locks in several ways. The examples utilize retaining and releasing features that automatically operate the hardware to lock the sashes and reset the system for use (locking) upon opening of the sashes. This ensures an adequate weather seal is established when the sashes are closed. Further, the retaining mechanism also prevents movement of the lock handle to the locked position while the sashes are open. Accordingly damage to the sashes is prevented that may otherwise occur with an unintentionally deployed latch blade. Further, the example fenestration hardware assemblies are fashioned with a traditional aesthetic. The mechanisms are concealed in a housing and the sash and the hardware thereby appears similar to a sweep and keeper lock. However, the fenestration hardware assemblies further control automatic locking of the sashes and tilting. Further still, the fenestration hardware assemblies described herein provide the latch blade at a position remote from the perimeter of the fenestration assembly. Accordingly, variations in the placement of components (e.g., due to out of square installations) are mitigated for the fenestration hardware assembly because the components are remote relative to the perimeter where shifting due to installation variations is most pronounced.

Stated another way, the operation hardware assembly and the blade socket locations, shapes and operation alleviates sensitivity to product installation and manufacturing variations.

FIG. 1A shows one example of a fenestration assembly 100 including one or more panels such as sashes. In the view shown in FIG. 1A the fenestration assembly 100 is a window assembly having a first sash 104 and a second sash 106. In other examples, the fenestration assembly 100 includes a window or door assembly and the sashes are panels. In the example shown in FIG. 1A, one or more of the first and second sashes 104, 106 is moveably coupled with a fenestration frame 102 of the fenestration assembly 100.

In the view shown in FIG. 1A, the sashes 104, 106 are shown closed and in locked configurations. Each of the sashes (including panels where the fenestration assembly is a door assembly) include respective stiles, rails or the like extending around one or more features of the sashes, for instance, glass panes. The first sash 104 includes a sash bottom rail 110, a sash check rail 114 and sash stiles 108 extending vertically between the sash bottom rail 110 and the sash check rail 110. In a similar manner, the second sash 106 includes a sash bottom rail 112 and a sash upper rail (hidden by the fenestration frame 102). The second sash 106 further includes sash stiles 108 extending between the sash bottom rail 112 and the sash top rail.

As further shown in FIG. 1A, the fenestration assembly 100 includes a fenestration hardware assembly 116. An operator of the fenestration hardware assembly 116 as well as an operator assembly is shown positioned along the sash check rail 114 (e.g., remote from the edges of the check rail and the fenestration frame and proximate to the interior of the assembly). As will be described herein, the fenestration hardware assembly 116 includes the components shown in FIG. 1A, corresponding components, for instance, on the sash bottom rail 112 of the second sash 107 as well as one or more latch bolts configured to facilitate the tilting of one or more of the first or second sashes 104, 106. The fenestration hardware assembly 116 described herein provides consolidated operation for locking and unlocking each of the first and second sashes 104, 106 to facilitate sliding movement of the sashes within the fenestration frame 102 and also to provide tilting operation of one or more of the sashes, for instance, the first sash 104, the second sash 106 or both relative to the fenestration frame 102 (e.g., for cleaning, maintenance or the like).

Figure 1B:
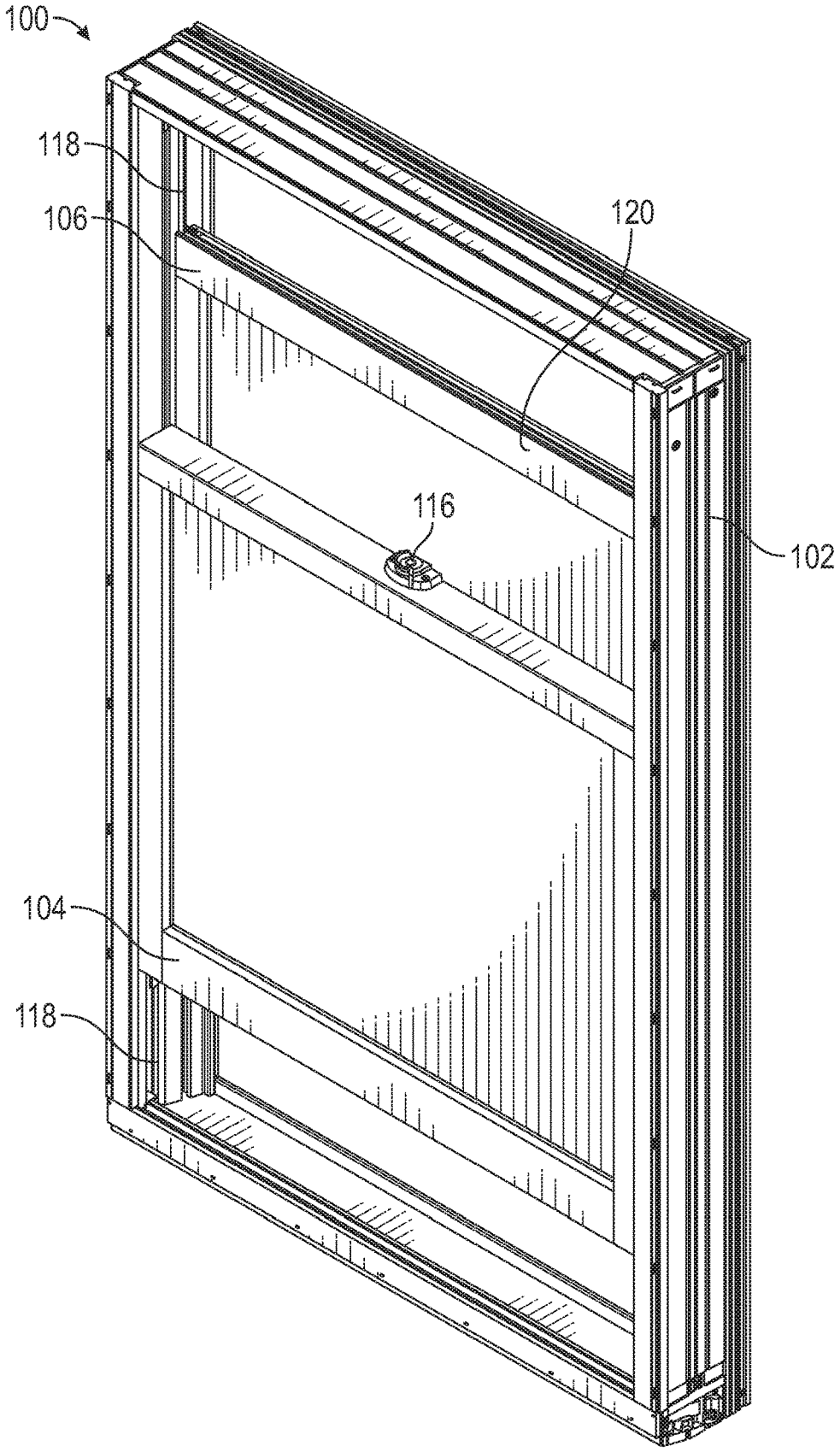
FIG. 1B is a perspective view of the fenestration assembly of FIG. 1A in an open configuration.

Referring now to FIG. 1B, the fenestration assembly 100 is shown in an unlocked and open configuration. For instance, one or more of the first sash 104 or the second sash 106 are in open positions. As shown in FIG. 1B, both of the first and second sashes 104, 106 are shown in open positions. Opening of the second sash 106 reveals a top rail 120 of the sash 106.

As further shown in FIG. 1B, one or more latch bolt recesses 118 extend along portions of the fenestration frame 102, for instance, along jamb components. One or more of the latch bolts provided with each of the first and second sashes 104, 106 are received within the latch bolt recesses 118 and are configured to constrain movement of the sashes 104, 106 (when unlocked) in a vertical fashion relative to the fenestration frame 102. As will be further described herein, the fenestration hardware assembly 116 is configured to operate the latch bolts and decouple the bolts from the latch bolt recesses 118 to facilitate rotation of one or more of the first or second sashes 104, 106 relative to the fenestration frame 102.

Figure 1C:
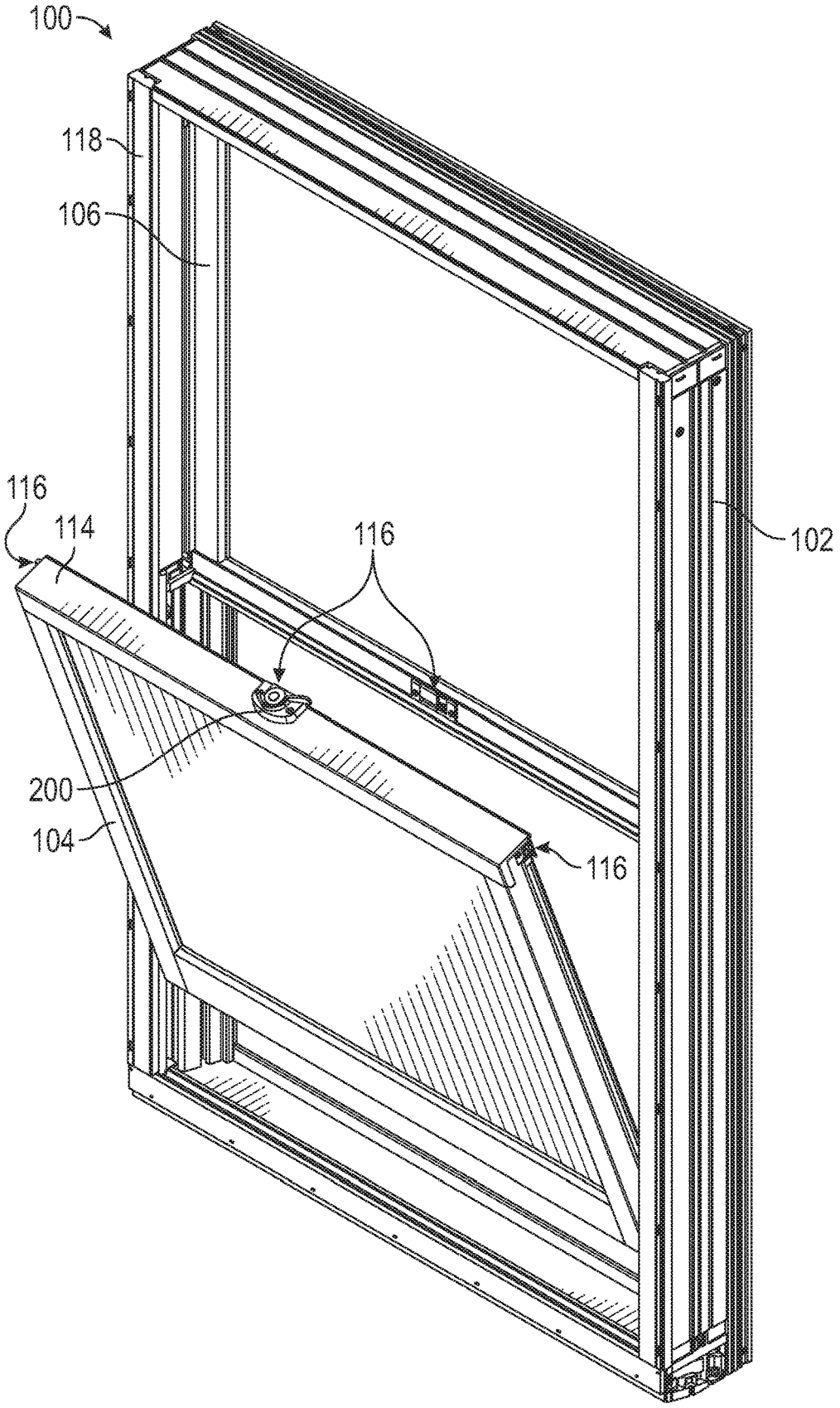
FIG. 1C is a perspective view of the fenestration assembly of FIG. 1A in a tilting configuration.

In FIG. 1C the fenestration assembly 100 is transitioned into a tilting configuration, for instance, with one or more of the sashes, such as the first sash 104, in a tilted configuration relative to the fenestration frame 102. In the example shown in FIG. 1C, the fenestration hardware assembly 116 is operated to withdraw the one or more latch bolts from the respective latch bolt recesses 118 and facilitate the rotation of the first sash 104 relative to the fenestration frame 102. For instance, a lever, knob or the like provided at the operator assembly 200 on the check rail 114 is moved to a tilting position that withdraws the latch bolts. One or more tying elements, such as ribbons, cords, cables or the like, extend from the operator assembly 200 to the one or more latch bolt assemblies, for instance, provided at the ends of the check rail 114 on the first sash 104. Accordingly, movement of the operator interface feature at the operator assembly 200 (of the fenestration hardware assembly 116) retracts the tying elements and operates the latch bolt assemblies to withdraw the latch bolts relative to the latch bolt recesses 118 and free the first sash 104 for rotation and tilting into the configuration shown in FIG. 1C.

Figure 2:
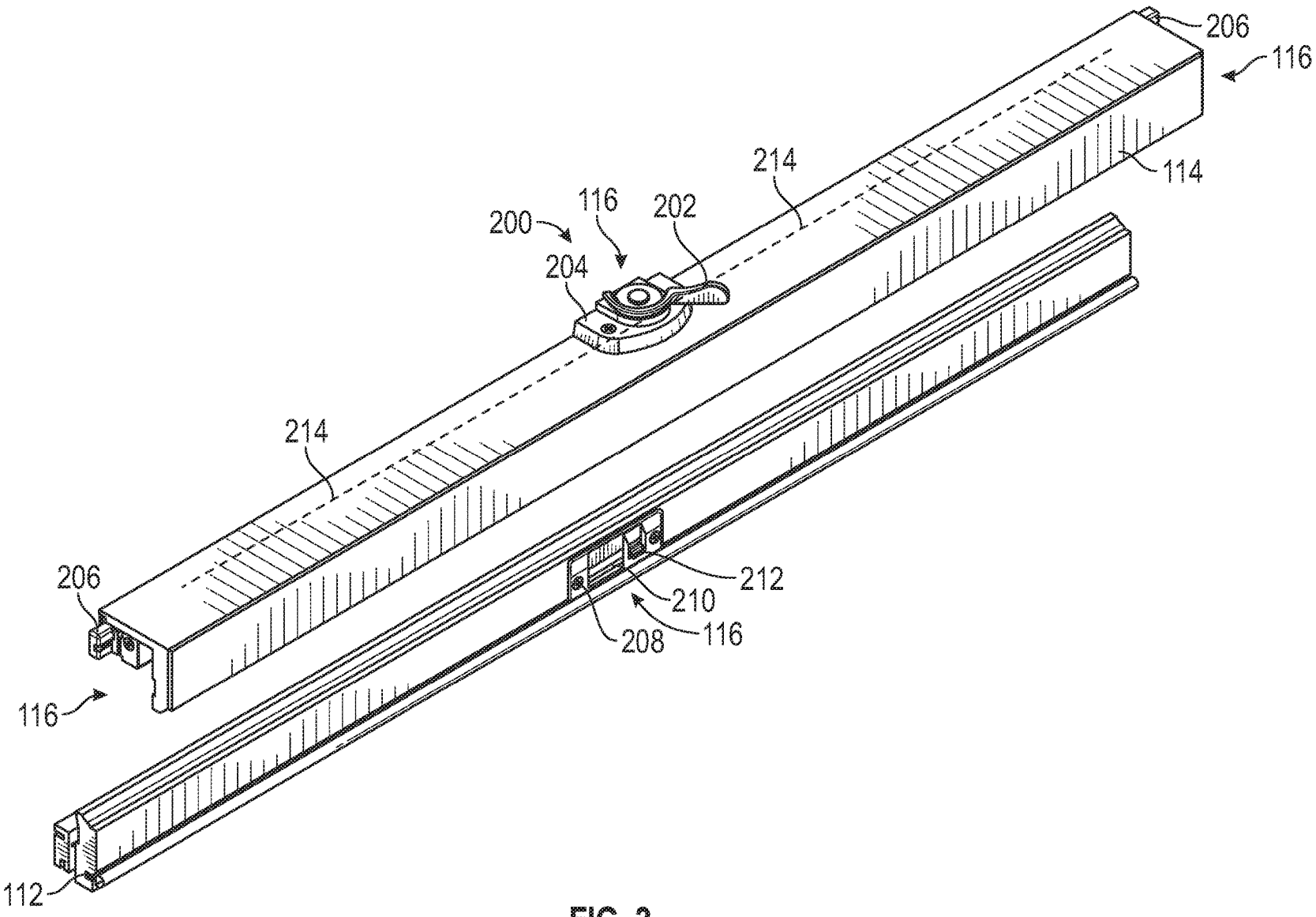
FIG. 2 is a detailed perspective view of portions of two sashes including one example of a fenestration hardware assembly.

FIG. 2 shows a detailed view of one or more of the rails of the respective sashes previously described herein. For instance, the sash bottom rail 112 of the second sash 106 and the sash check rail 114 of the first sash 104 are shown in an offset configuration to illustrate one or more components of the fenestration hardware assembly 116. As further shown in FIG. 2, the fenestration hardware assembly 116, in this example, includes an operator assembly 200, a blade socket 208 and one or more latch bolt assemblies 206, for instance, provided at ends of the sash check rail 114. A tying element 214 (shown in broken lines) including a ribbon, cable, element or the like extends from the operator assembly 200 to each of the latch bolts 206.

As further shown in FIG. 2, the fenestration hardware assembly 116 is accordingly installed within and extends along one or more components of the fenestration assembly 100. One or more of the components of the fenestration assembly 116 are concealed by components of the fenestration assembly 100 including the sash check rail 114 and the sash bottom rail 112. The operator assembly 200 is coupled with the sash check rail 114 at an interior location relative to the perimeter of the fenestration assembly 100, and is at least partially installed within a corresponding recess in the check rail 114. The fenestration assembly 100 accordingly provides a clean aesthetically appealing appearance having a profile similar to sweep and keeper hardware.

Referring again to FIG. 2, fenestration hardware assembly 116 includes the operator assembly 200 as shown. In the example provided in FIG. 2, the operator assembly 200 includes an operator housing 204 and an operator interface feature 202. The operator interface feature 202 is moveable relative to the operator housing 204. In this example, the operator interface feature 202 is rotatable relative to the operator housing 204, for instance, from an unlocked configuration shown in FIG. 2 to a locked configuration as well as a tilting configuration shown further herein.

As previously described, one or more tying elements 214 extend from the operator housing 204 to one or more corresponding latch bolt assemblies 206 provided at the ends of the sash check rail 114. Continued rotation of the operator interface feature 202, for instance, beyond the unlocked configuration moves the tying elements 214 and accordingly withdraws the latch bolts of each of the latch bolt assemblies 206 out of corresponding latch bolt recesses 118 shown, for instance, in FIGS. 1B and 1C to free one or more of the sashes 104, 106 to tilt relative to the frame 102.

As further shown in FIG. 2, the fenestration hardware assembly 116 includes a blade socket 208. In the example shown, the blade socket 208 includes a blade recess 210 configured for reception of a latch blade that movably projects from the operator assembly 200 (e.g., with operation of the operator interface feature 202). As further shown in FIG. 2, the blade socket 208 includes, in another example, a strike button 212 configured to engage with one or more features of the operator assembly 200 including a release assembly. Engagement of the strike button 212 with the release assembly (e.g. a plunger) with closing of the sashes 104, 106 triggers the operator assembly 200 to release the operator interface feature 202 and automatically lock each of the sashes 104, 106 in the closed configuration, for instance, with each of the sashes 104, 106 in respective closed positions shown in FIG. 1A.

Figure 3:
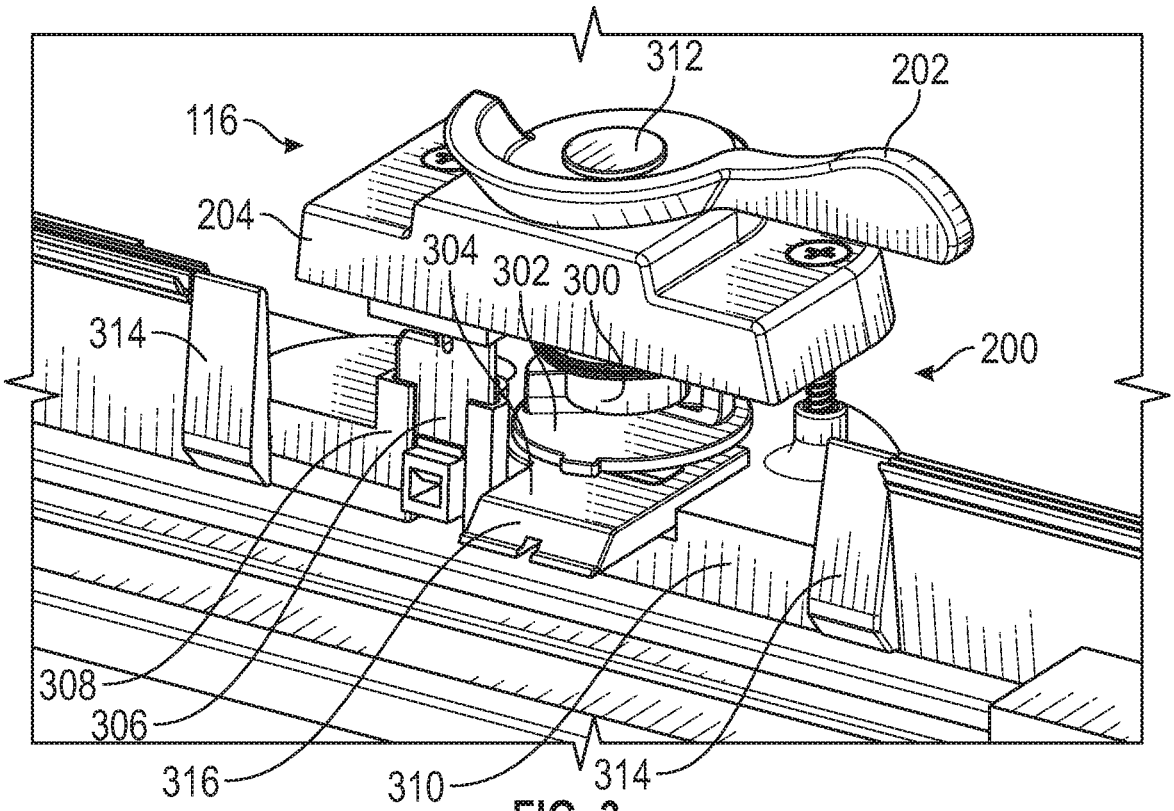
FIG. 3 is a perspective view of one example of an operator assembly of the fenestration hardware assembly shown in FIG. 2.
Figure 4:
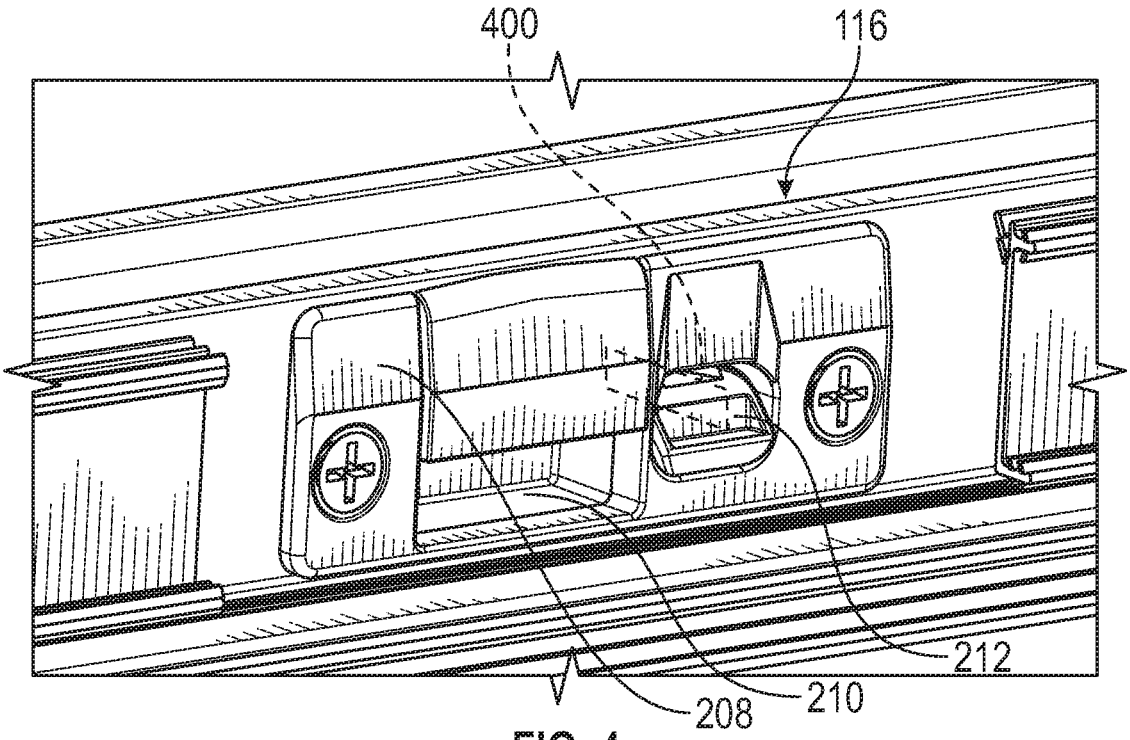
FIG. 4 is a perspective view of one example of a blade socket of the fenestration hardware assembly shown in FIG. 2.
Figure 5:
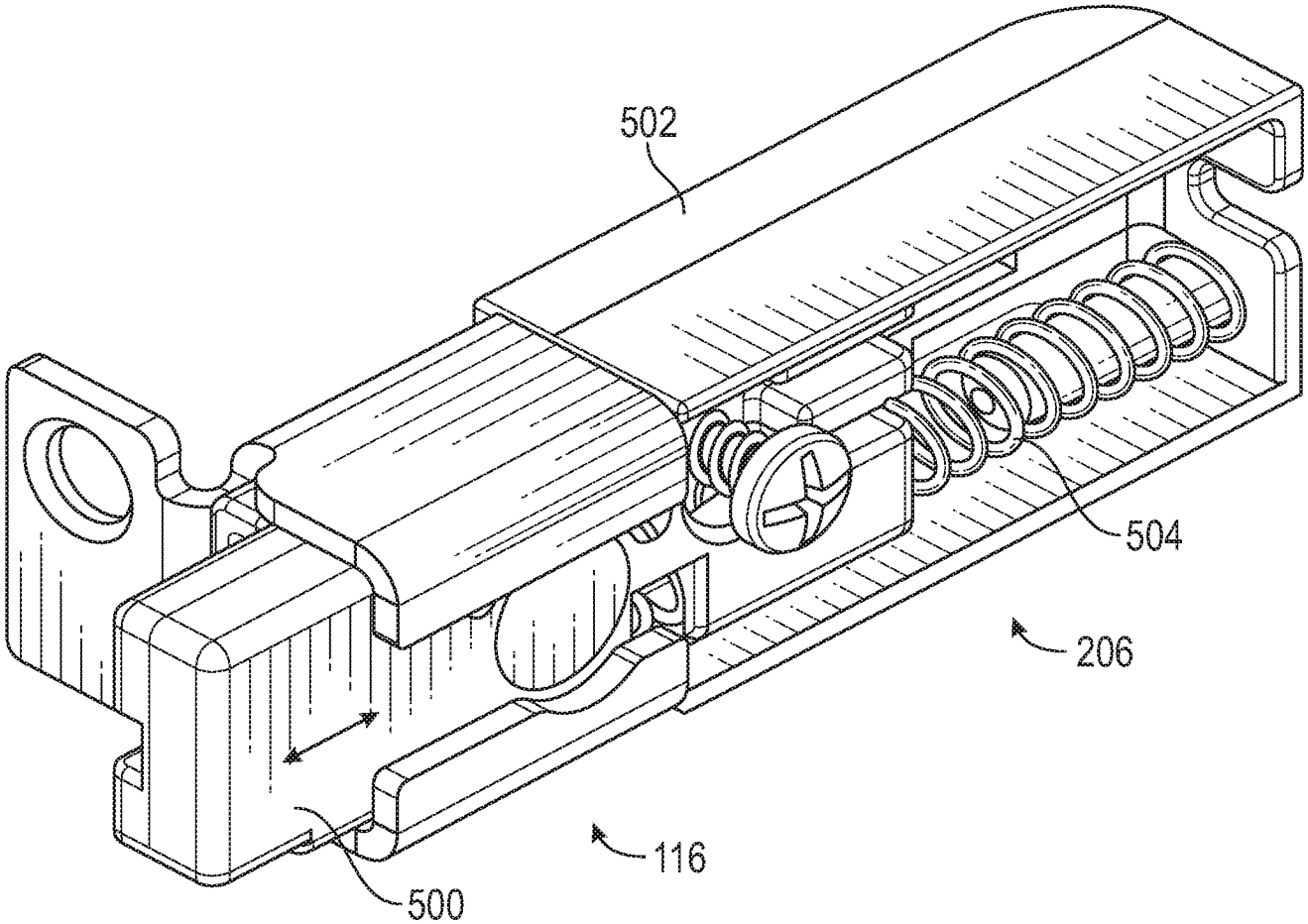
FIG. 5 is a perspective of one example of a latch bolt of the fenestration hardware assembly shown in FIG. 2.

FIGS. 3, 4 and 5 show various example components of the fenestration hardware assembly 116. Referring first to FIG. 3, the operator assembly 200 is shown in a partially revealed view, for instance, while installed within one or more rails such as the check rail 114 of the first sash 104. In FIG. 3, a portion of the operator housing 204, for instance a guide housing, is removed to accordingly expose internal features of the operator assembly 200. As shown, an operator interface feature 202 is rotatably coupled with the operator housing 204. As further shown, a spindle 300 (e.g., a component of the feature 202) is provided within the operator housing 204 and extends for coupling with a spool 302. The spool 302 is coupled with a latch blade 304, and as described further herein the tying element 214 (see FIG. 2).

The operator interface feature 202 is configured to move and accordingly operate each of the spindle 300, spool 302 and the latch blade 304. For instance, in one example, the operator interface feature 202 is fixed rotationally relative to the spindle 300. For instance, the spindle 300 is a component of the operator interface feature 202 and coupled with a shaft, feature or the like that facilitates the transmission of rotational movement from the user operable portion of the operator interface feature 202 (e.g., a handle) to the spindle 300. In one example, the spindle 300 includes one or more spindle legs configured for engagement with one or more spool legs described further herein. The spool legs, in one example, are coupled with the spool 302. Interfitting of the spool legs and the spindle legs of the respective spool 302 and spindle 300 facilitates the transmission of rotation from the operator interface feature 202 to the spool 302. In various examples, the spindle legs and spool legs are, in one example, forks, tines, wedges or the like configured to engage and transmit rotation from the spindle 300 and the operator interface feature 202 to the spool 302 to move the latch blade 304 between the withdrawn and deployed configurations.

In one example, the spool 302 includes a cam, such as a pin, cam element or the like provided on an opposed surface of the spool 302 and coupled with a cam follower of the latch blade 304, such as a cam slot. Accordingly, rotation of the operator interface feature 202 is transmitted through the spindle 300 and the spool 302 to translate the latch blade 304 between the deployed position shown in FIG. 3 and the withdrawn position shown herein. In another example, translation of the latch blade 304 includes reciprocation of the latch blade 304 between deployed and withdrawn positions.

As further shown in FIG. 3, in one example, the operator assembly 200 includes one or more tilt stopping features, for instance, a tilt stop button 312 coupled with the operator interface feature 202. In the example shown in FIG. 3, the tilt stop button 312 is a depressible button extending from the operator interface feature 202. In operation where tilting is desired, the operator interface feature 202 is rotated from the locked position shown in FIG. 3 to an unlocked position (in some examples, corresponding to a degree measure of around 135 degrees relative to the locked configuration). From the unlocked position, the operator interface feature 202 is, in one example, rotated further to retract the latch bolts from the corresponding latch bolt recesses 118 shown, for instance, in FIG. 1C. The tilt stop button 312 is, in one example, operated to free the operator interface feature 202 for further movement into a tilting position. For instance, the tilt stop button 312 is, in one example, depressed relative to a projecting position to release the operator interface feature 202 from engagement with the stop feature and allow continued rotation of the operator interface feature 202 toward the tilting position that withdraws one or more of the latch bolts from the corresponding latch bolt recesses.

As further shown in FIG. 3, the operator housing 204, in one example, includes a plurality of housings, for instance, a blade housing 310 in addition to the operator housing shown coupled with the operator interface feature 202. In yet another example, the guide housing (removed from FIG. 3 to accordingly reveal components therein) is also included as a portion of the operator housing 204. In still other examples, one or more of the blade housing, guide housing or the like is not included with the operator housing 204. In one example, these features are removed and corresponding recesses, walls and the like, for instance, in the check rail 114, are used as corresponding features to the blade housing 310, guide housing or the like to retain components of the operator assembly 200.

In another example, the operator assembly 200 includes one or more features configured to facilitate resetting of the operator assembly 200 to automatically lock the assembly 200 and the corresponding sashes such as the first and second sashes 104, 106 with positioning of each of the sashes in the closed configuration, for instance, with the closed positions shown in FIG. 1A. In the example shown in FIG. 3, the operator assembly 200 incudes a plunger 306 moveably coupled relative to the operator assembly 200 and guided when moving, for instance, by a plunger guide 308. As shown in FIG. 3, the plunger guide 308 provides a slot exposing at least a portion of the plunger 306 proximate to the latch blade 304. As will be described herein, the strike button 212 (shown in FIG. 2) engages with the plunger 306 during closing of the first and second sashes 104, 106 (including, but not limited to, closing of one of the open sashes relative to a previously closed sash). Engagement of the strike button 212 with the plunger 306 initiates engagement between components of a release assembly with a retaining mechanism within the operator assembly 200 that releases the operator interface feature 202 and allows the feature 202 to return to the locked position with the latch blade 304 correspondingly projecting to the deployed position (from the withdrawn position) and received within the blade recess 210 of the blade socket 208. As described herein, in one example, reception of the latch blade 304, for instance, within the blade recess 210 (provided on the opposed sash such as the second sash 106) locks both of the first and second sashes 104, 106 in place while the interfitting of the blade 304 and the recess 210 is concealed by the closed sashes 104, 106. This provides a clean aesthetically appealing profile for the assembly 116.

In another example, the operator assembly 200 includes one or more partitions, screens, baffles or the like configured to prevent unintentional interaction with one or more of the auto locking features, for instance, the plunger 306. In the example shown in FIG. 3, reset baffles 314 are provided on either side of the operator assembly 200. As shown, the reset baffles 314 project away from one or more of the components of the operator housing 204 and bracket the area occupied by the plunger 306 and the plunger guide 308. Accordingly, interaction with the operator assembly 200, for instance with fingers, is screened from the plunger 306 to prevent unintentional triggering of the release assembly. Instead, fingers and other objects more readily engage with the reset baffles 314. Accordingly, the fenestration hardware assembly 116 is screened from unintended operation of the plunger 306 and corresponding unintentional deployment of the latch blade 304 and release of the operator interface feature 202 while the sashes 104, 106 are open.

In a further example, the latch blade 304 includes one or more tapered features configured to facilitate the reception of the latch blade 304 for instance, during auto locking within the blade recess 210, with out of square assembly 100 installations or the like. The latch blade 304 including the blade taper 316 is readily received within the blade recess 210. The blade socket 208 including the blade recess 210 is, when the sashes 104, 106 are closed, aligned with the operator assembly 200. Accordingly, with movement of each of the sashes 104, 106 to a closed position, the deploying latch blade 304 is received within the blade recess 210. In some examples, the upper sash, for instance, the second sash 106 shown in FIG. 1A, while in the closed position is subject to settling over time, for instance, through the relaxing of one or more springs, tolerances between the sash and the fenestration frame or the like. Accordingly, the second (upper) sash 106 settles or depresses relative to the closed configuration shown in FIG. 1C and the blade recess 210 does not fully align with the latch blade 304. Accordingly, with deployment of the latch blade 304, in one example, misalignment therebetween prevents the reception of the latch blade 304 within the blade recess 210 and accordingly precludes locking of the first and second sashes 104, 106. The inclusion of the blade taper 316 facilitates the reception of the latch blade 304 within the blade recess 210 even with settling. With settling of the second sash 106 (e.g., below its fully closed position) the blade recess 210 remains in at least partial alignment with the latch blade 304. Because of the blade taper 316 (e.g., tapering toward the bottom of the latch blade 304) at least a portion of the latch blade 304 is received within the blade recess 210. Accordingly, the first and second sashes 104, 106 are still reliably locked. Additionally, the user may, if desired, move the second sash 106 from the settled position after reception of the latch blade 304 partially within the blade recess 210 to fully seat the latch blade 304 into the blade recess 210.

Additionally, the blade taper 316 enhances the reception of the latch blade 304 within the blade recess 210 with out of square installation, for instance, with one or more of the fenestration frame 102, sashes 104, 106 out of square with each other, the wall or the like. Because the blade recess 210 has a relatively large profile in comparison to the tapered tip of the latch blade 304 the blade 304 is readily received in the recess 210 even where there is some installation-based misalignment between the recess 210 and the latch blade 304.

Further, although the latch blade 304 is described as a blade, in other examples the latch blade 304 includes, but is not limited to, a tongue, plate, bar, post or the like configured to deploy from the operator assembly 200 for reception in a recess, such as the recess 210, of the opposed sash to lock the sashes 104, 106.

FIG. 4 shows an example blade socket 208 of the fenestration assembly 116. The blade socket 208 includes the blade recess 210 configured for reception of the latch blade 304 whether in full alignment, partial alignment (e.g., because of settling, installation-based misalignment or the like). As further shown in FIG. 4, the blade socket 208 includes a strike button 212 configured to interact with one or more resetting or auto locking features of the operator assembly 200 (see FIG. 3), such as a release assembly. The strike button 212, in one example, is a feature movably coupled with the blade socket 208. In still other examples, a strike biasing element 400 is coupled between the blade socket 208 and the strike button 212 to provide bias to the strike button 212 and accordingly present the strike button 212 in a deployed fashion relative to the one or more features of the release assembly, such as the plunger 306 shown in FIG. 3.

In operation, the strike button 212 remains in a projecting configuration relative to the blade socket 208. As the sashes 104, 106 are moved toward respective closed positions the plunger 306, in one example, is engaged with the strike button 212. Engagement between these two components biases the plunger 306 upwardly, for instance, in an opposed fashion relative to the bias provided by a biasing element associated with the plunger 306. The plunger 306 accordingly engages with components (e.g., other components of a release assembly) within the operator housing 204 including, for instance, a release element, a detent element or the like to release the operator interface feature 202 and release the operator assembly 200 to move toward a locking configuration, for instance, with the latch blade 304 deployed and received within the blade recess 210. Additionally, because the strike button 212 is positioned adjacent to the blade recess 210 as shown in FIG. 3, the strike button 212 readily navigates between the optional reset baffles 314 of the operator assembly 200. Accordingly, the strike button 212 readily engages with components of a release assembly, such as the plunger 306, to trigger automatic locking (e.g., auto locking) of the operator assembly 200 and corresponding locking of the closed sashes 104, 106.

FIG. 5 shows another example component of the fenestration assembly 116. This component of the fenestration assembly 116 includes a latch bolt assembly 206. As previously described herein, in at least one example, one or more of the sashes includes one or more latch bolt assemblies 206 to constrain movement of the sash 104. For instance, the latch bolt assemblies constrain one or more of the sashes 104, 106, such as the first sash 104, to sliding movement. Operation of the latch bolt assemblies to retract latch bolts 500 from the latch bolt recesses 118 (see FIG. 1B) releases the sash 104 for tilting operation. Tilting of the sash 104 provides access to the opposed side of the sash for cleaning, removal, maintenance or the like.

In the view shown in FIG. 5, the latch bolt assembly 206 of the fenestration hardware assembly 116 includes a latch bolt biasing element 504 coupled between a latch bolt housing 502 and the latch bolt 500. The latch bolt biasing element 504 biases the latch bolt 500 to a deployed configuration as shown in FIG. 5. An element such as the tying element 214, including, but not limited to, a flexible ribbon, cable, string or the like extends from one or more other components of the fenestration hardware assembly 116 including, for instance, the operator interface feature 202 (including the spool 302) to the latch bolt 500. Accordingly, retraction of the tying element 214 withdraws the latch bolt 500 by overcoming the bias provided by the latch bolt biasing element 504.

Figure 6A:
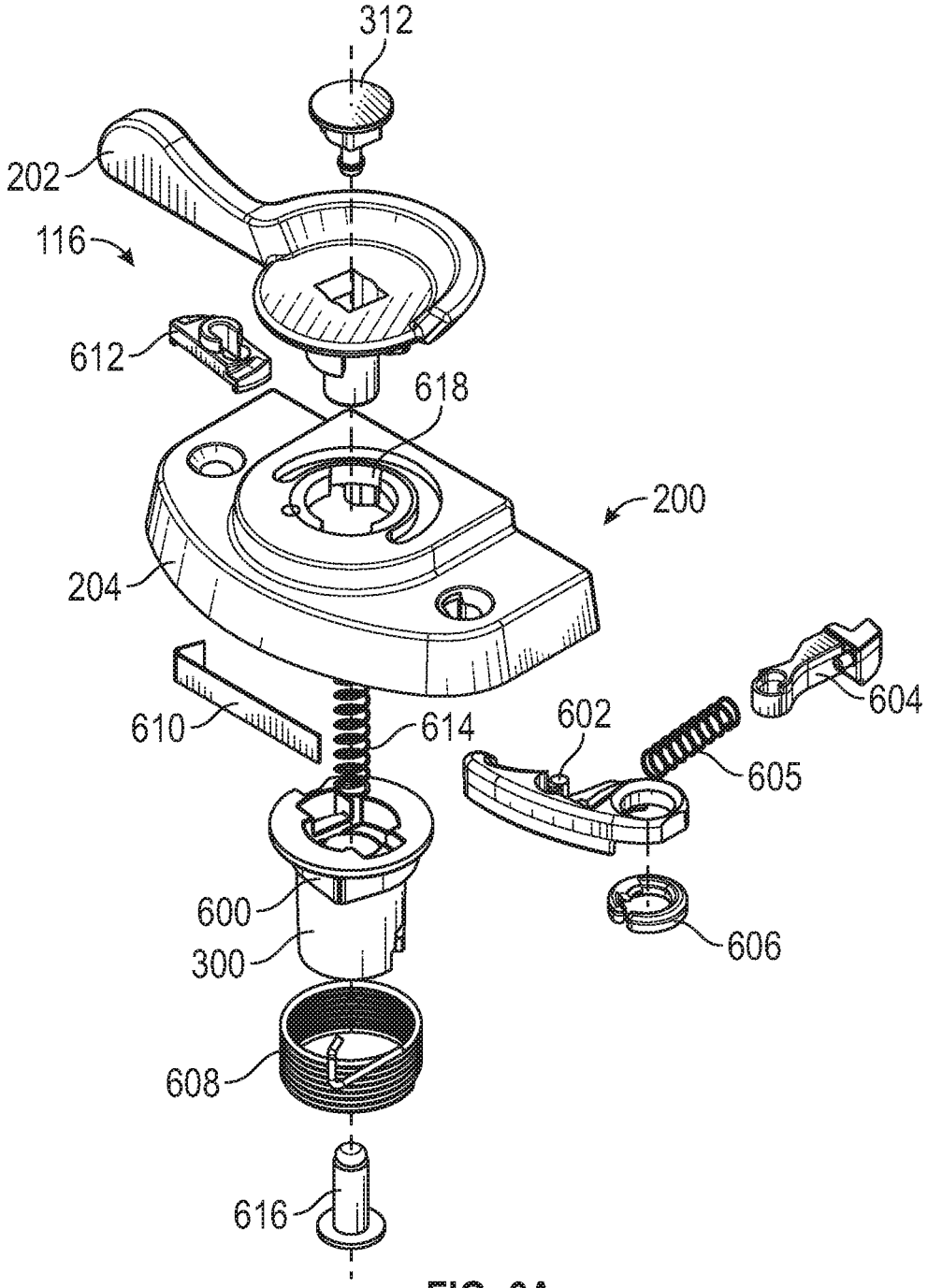
FIG. 6A is an exploded view of a first portion of the operator assembly of FIG. 3.
Figure 6B:
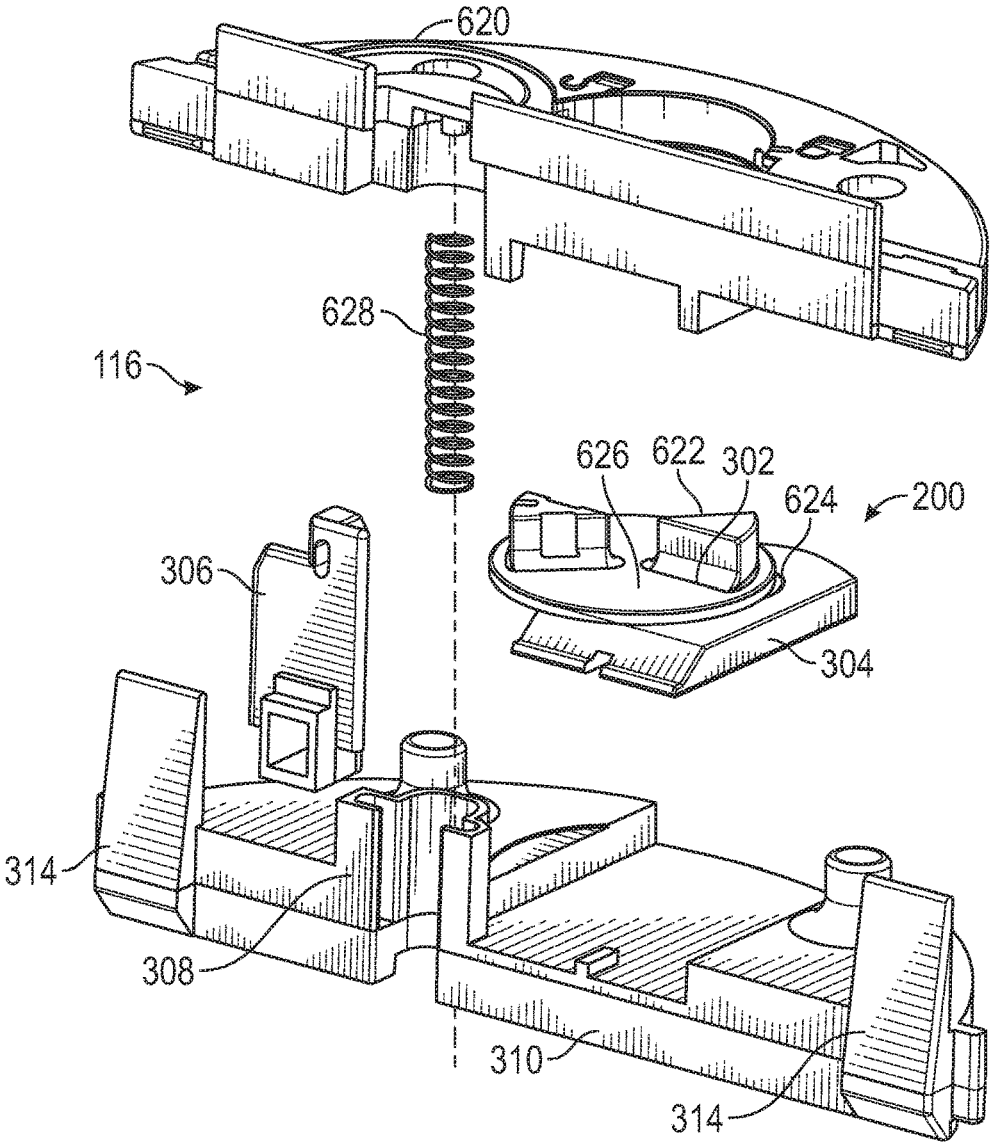
FIG. 6B is an exploded view of a second portion of the operator assembly of FIG. 3.

FIGS. 6A and 6B show exploded views of example components of the operator assembly 200 of the fenestration hardware assembly 116. Referring first to FIG. 6A, one example of the upper components of the operator assembly 200 is provided. As shown, the operator interface feature 202 is positioned above the operator housing 204 of the assembly 200. The operator interface feature 202 includes one or more features including the component lever, knob or the like, and optionally includes other components of the assembly 200 including, but not limited to, the spindle 300, spool 302 and the like. The user operated portion of the operator interface feature 202 optionally includes a noncircular shaft, peg with splines, keys or the like configured for reception within the spindle 300.

As will be described herein, the spindle 300 includes one or more features configured to transmit rotation and initiate resetting of one or more of a retaining mechanism or release assembly. In this example, the spindle 300 includes a spindle reset 600 as well as one or more detent notches configured to receive a detent and accordingly hold the operator interface feature 202 in the unlocked position. The spindle 300 further includes one or more interfitting features, such as spindle legs described further herein, configured to interfit with one or more corresponding spool legs 622 shown, for instance, in FIG. 6B. Interfitting of the spindle legs and spool legs 622 transmits rotation from the operator interface feature 202 through the spindle 300 into the spool 302 to initiate movement of the latch blade 304 as previously described herein. As further shown in FIG. 6A, an operator biasing element 608, for instance, a torsion spring or the like is coupled with the spindle 300. The operator biasing element 608 is configured to bias the operator interface feature 202 toward the locked position. Further, the operator biasing element 608 biases the latch blade 304 through interfitting of the spindle 300 and the spool 302 (e.g., with the respective legs). For instance, the operator biasing element 608 biases the latch blade 304 toward the deployed position that locks the sashes 104, 106 with reception of the blade 304 within the blade recess 210.

As further shown in FIG. 6A and previously described herein, the fenestration hardware assembly 116 includes a retaining mechanism in another example. For instance, the operator assembly 200 includes a detent element 602 configured for selective engagement with one or more components of the operator interface feature 202 to retain the feature 202 in one or more positions. Additionally, the detent element 602 releases the operator interface feature 202 during auto locking, for instance with closing of one or more of the sashes 104, 106. in an example, the retaining mechanism includes the detent element 602 pivotally coupled with the operator housing 204, for instance, by way of a pivot pin, for instance, provided integrally with the operator housing 204 (and concealed in the view shown in FIG. 6A). An optional pivot clip 606 is used to rotatably couple the detent element 602 along the operator housing 204.

The operator assembly 200 further includes a release assembly configured to interact with the retaining mechanism (e.g., the detent element) and thereby release the assembly 200 to auto lock. The release assembly in one example includes a release element 604 is further provided as a component of the retaining mechanism configured to release retention of the operator interface feature 202, for instance through selective engagement and movement of the detent element 602. In the example shown in FIG. 6A, a release bias element 605, for instance, a coil, spring or the like is configured for coupling with the release element 604 to accordingly bias the release element 604 toward a reset position aligned with the plunger 306, as described further herein. In addition to the release element 604, the release assembly includes the plunger 306, in another example.

As further described herein, the spindle 300 optionally includes a spindle reset 600. The spindle reset 600 engages with one or more components of the operator assembly 200, such as the release element 604, to selectively reset the assembly 200 and allow the detent element 602 to move toward the operator interface feature 202 (e.g., with bias provided by a detent biasing element 610, such as a leaf spring).

As further shown in FIG. 6A, the operator assembly 200 optionally includes one or more tilt stop features. The tilt stop features in this example include, but are not limited to, the tilt stop button 312 moveably coupled relative to the operator interface feature 202 and a tilt stop bar 612 provided at an opposed end of the tilt stop button 312. As further shown in FIG. 6A, the operator assembly 200 includes a stop biasing element 614 coupled with the tilt stop button 312. The stop biasing element 614 biases the button 312 and the tilt stop bar 612 into an elevated position relative to the depressed configuration. Optionally, the stop biasing element 614 is coupled between a stop cap 616 and the operator interface feature 202. The opposed end of the stop biasing element 614 (relative to the stop cap 616) is engaged with one or more of the tilt stop bar 612 or the tilt stop button 312 to bias the components relatively up.

In operation, translation of the tilt stop button 312, for instance depression, moves the tilt stop bar 612 out of alignment with a tilt stop recess 618 and frees the operator interface feature 202 to rotate beyond the unlocked position. Rotation of the operator interface feature 202 toward the tilting position (see FIG. 8C) rotates the tilt stop bar 612 beneath the tilt stop recess 618. Release of the operator interface feature 202, for instance, while in the tilt position allows the operator biasing element 608 to bias the operator interface feature 202 toward the locked configuration. For instance, in one example, the operator biasing element 608 moves the operator interface feature 202 from the released tilt position to the unlocked configuration where the detent element 602 optionally engages with one or more detent notches of the spindle 300 to accordingly hold the operator interface feature 202 at the unlocked position. At this location, the tilt stop bar 612 biased by the stop biasing element 614 into alignment with the tilt stop recess 618 to accordingly prevent return movement of the operator interface feature 202 toward the tilting position (unless the tilt stop button 312 is again depressed).

FIG. 6B shows another view of example components of the operator assembly 200. In this example, the guide housing 620 previously removed in FIG. 3 is shown exploded along with the other components of this portion of the assembly 200. The guide housing 620 provides one portion of a housing that contains the spool 302, the latch blade 304 and one or more other components. In this example, the blade housing 310 provides the opposed housing portion. Optionally, the guide housing 620, blade housing 310 and the like are absent from the operator housing 204. For instance, one or more of recesses, other fittings or the like formed in the check rail 114 or provided in the check rail 114 of the first sash 104 retain the components including the spool 302 and the latch blade are used instead of the guide housing 620 and blade housing 310.

Referring again to FIG. 6B, this portion of the operator assembly 200 includes the latch blade 304 (shown in the withdrawn position) engaged with the spool 302. As further shown in FIG. 6B and partially concealed, a cam follower 624 such as a slot or the like is provided in the latch blade 304 to facilitate camming movement of the latch blade 304 through rotation of the spool 302 (e.g., with an opposed eccentric cam on the spool as shown herein). As further shown with the spool 302, one or more spool legs 622 extend from the spool face 626 for engagement with corresponding features on the spindle 300, such as spindle legs. Additionally, the spool legs 622 provide one or more features configured to wrap the tying element 214 shown in FIG. 2 to retract or withdraw the latch bolts and facilitate tilting of one or more of the sashes 104, 106 of the fenestration assembly 100. Rotation of the operator interface feature 202, for instance, past the unlocked configuration and into the tilting configuration is transmitted through the spindle 300 (shown in FIG. 6A) to the spool 302 through interfitting between the spool legs 622 and the spindle legs. A cam (e.g., a projection, pin or the like) eccentric relative to a rotational axis of the spool 302 extends from a face of the spool 302 opposed to the spool face 626. Rotation of the spool 302 and accordingly the cam (shown herein) translates the latch blade 304 having the cam follower 624.

In another example, the portion of the operator assembly 200 shown in FIG. 6B includes one or more other components of a release assembly. For instance, the plunger 306 and a plunger biasing element 628 are shown in exploded positions relative to the plunger guide 308. In one example, the plunger biasing element 628 is interposed between the plunger 306 and the guide housing 620. Accordingly, the plunger 306 is biased downwardly relative to the remainder of the operator assembly 200. The downward bias of the plunger 306 is away from the release element 604 and accordingly prevents resetting of the operator assembly 200 until the sashes 104, 106 are both closed and the plunger 304 and the strike button 212 are thereby engaged.

Figure 7:
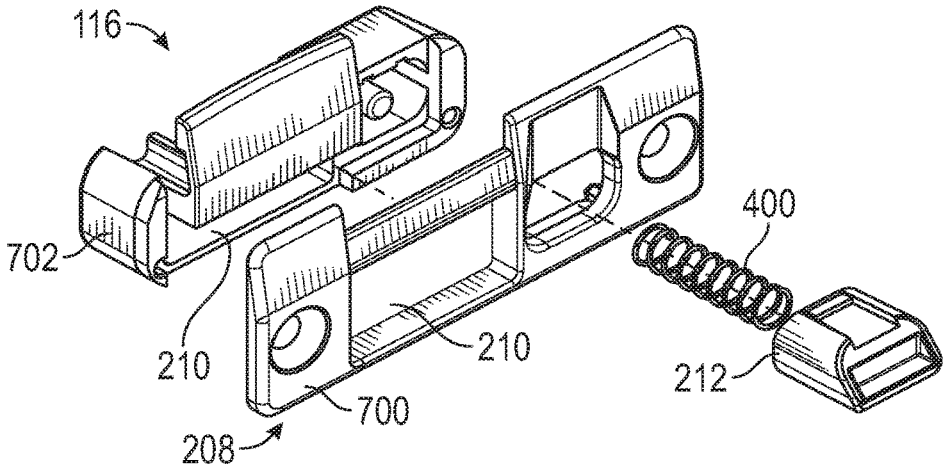
FIG. 7 is an exploded view of the blade socket of FIG. 4.

FIG. 7 shows one example of the blade socket 208 of the fenestration hardware assembly 116 in an exploded configuration. In this example, the blade socket 208 includes both a socket plate 700 and a socket housing 702. In another example, the blade socket 208 includes the plate and housing as a unitary component having the blade recess 210 therein. In the example shown in FIG. 7, the blade recess 210 extends through both the socket plate 700 and the socket housing 702. The blade recess 210 is sized and shaped to receive the latch blade 304 shown, for instance, in FIG. 6B. In another example the blade recess 210 has a larger profile than that of the latch blade 304 (e.g., the blade cross sectional area) to facilitate reception of even a partially misaligned latch blade, for instance because of settling of the sash 106, installation variations or the like. The blade taper 316 further enhances the reception of the latch blade 304 within the larger profile blade recess 210 by further minimizing the leading end profile of the latch blade.

As further shown in FIG. 7, the strike button 212 and the strike biasing element 400 are also shown exploded relative to the socket housing 702. When assembled, the strike button 212 is coupled with the strike biasing element 400, and the strike biasing element 400 is received within a corresponding portion of the socket housing 702. The strike button 212 is biased outwardly, for instance, relative to the socket plate 700 to provide a projecting component (relative to the remainder of the sash 106) for engagement with one or more other features of the operator assembly 200 including, in an example, the plunger 306. As previously described, engagement of the strike button 212 with the plunger 306 is used in one example to initiate release of the unlocked latch blade 304 and operator interface feature 202 and auto lock the operator assembly 200 and the sashes 104, 106.

Figure 8A:
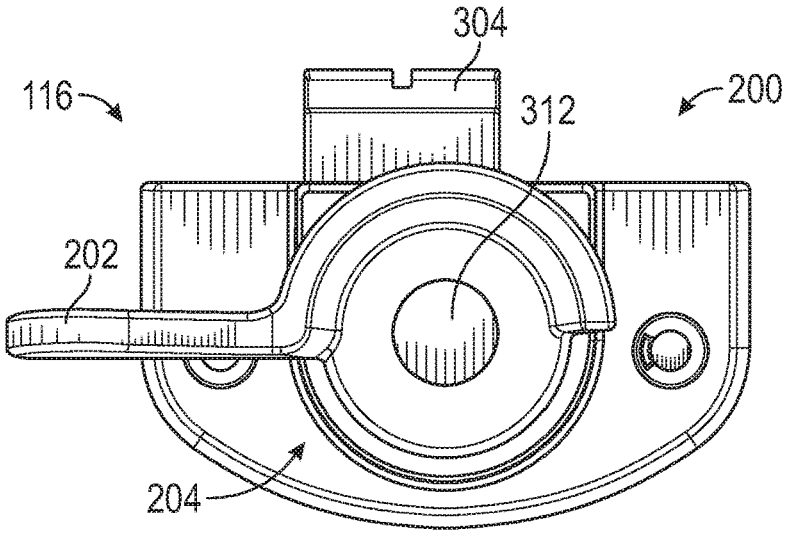
FIG. 8A is a top view of the operator assembly of FIG. 3 in a locked configuration with a latch blade in a deployed position.
Figure 8B:
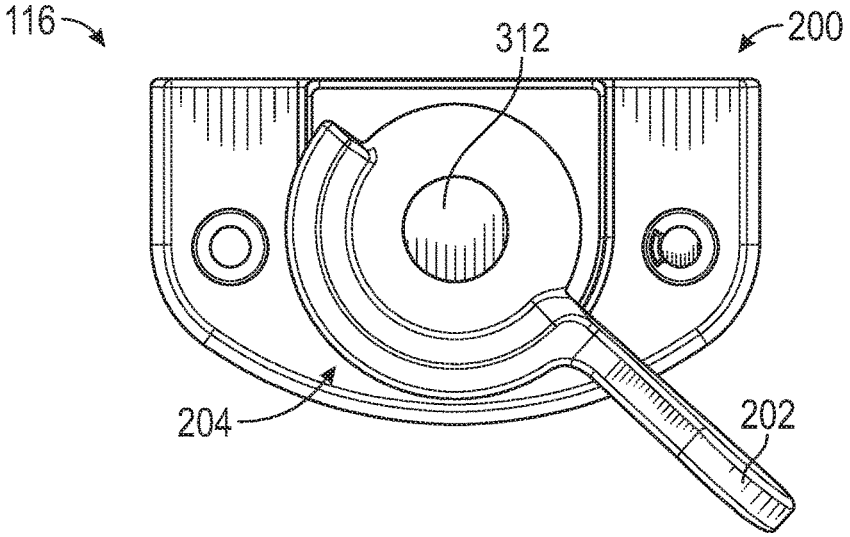
FIG. 8B is a top view of the operator assembly of FIG. 3 in an unlocked configuration.
Figure 8C:
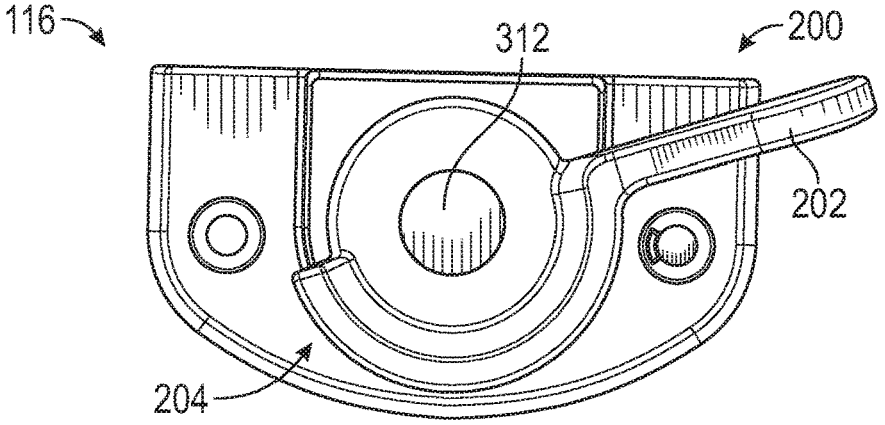
FIG. 8C is a top view of the operator assembly of FIG. 3 in a tilting configuration.

FIGS. 8A, 8B and 8C show the operator assembly 200, for instance, an operator interface feature 202 of the assembly 200 in a plurality of positions corresponding to unlocked, locked and tilting configurations of the fenestration hard ware assembly. Referring first to FIG. 8A, the operator interface feature 202 is shown in an initial position corresponding to a locked position of the fenestration hardware assembly 116. In this example, the latch blade 304 is shown in a deployed position relative to the operator housing 204. In the deployed position the latch blade 304 is received within the corresponding blade recess 210 of the blade socket 208(e.g., shown in FIG. 4). Additionally, the operator assembly 200 is biased toward the locked configuration. Operation of the releasing assembly (e.g., the plunger, release element and the like) releases a retaining mechanism, such as the detent element 602, to allow the operator assembly 200 to return from the other configurations to the locked configuration.

Rotation of the operator interface feature 202, for instance, into the unlocked configuration shown in FIG. 8B moves the latch blade 304 into a withdrawn position, for instance, within the operator housing 204. The latch blade 304 is thereby recessed outside of the blade recess 210 and the first and second sashes 104, 106 are unlocked and ready to open. In the view shown in FIG. 8B, the operator interface feature 202 is rotated approximately 135 degrees. In this position, one or more detent notches are provided, for instance, on the spindle 300 of the operator interface feature 202 (see FIG. 6A) or other components of the operator interface feature 202. Reception of the detent of the detent element 602 in one or more detent projections holds the operator interface feature 202 in the unlocked position and correspondingly also retains the latch blade 304 in the withdrawn position within the blade housing 310.

One example of the tilting position of the operator interface feature 202 is shown in FIG. 8C. Relative to FIG. 8B, the operator interface feature 202 is further rotated from the unlocked position. For instance, the operator interface feature 202 is rotated an additional degree measure, such as 60 degrees. In one example, the operator interface feature 202 is freed to move to the tilting position through operation of one or more tilt stop features. In the example shown in FIG. 8C, the tilt stop button 312 is operated (e.g., depressed) to accordingly move the tilt stop bar 612 (see FIG. 6A) out of alignment with the tilt stop recess 618. This misalignment releases the operator interface feature 202 to continue further rotation into the tilting position shown in FIG. 8C. Additionally, this rotation rotates the spindle 300 and spool 302 to accordingly wrap the tying element 214 and withdraw the latch bolts 500 (see FIG. 5) to free one or more of the sashes for tilting.

In the proceeding FIGS. 9-14, the operation of the example fenestration hardware assembly 116 is shown in detail. For instance, one or more intermediate configurations of the assembly 116 including the operator assembly 200 show the position and relative movement of various components in each of the configurations described herein (e.g., locked, unlocked and tiling). Each of the components of the operator assembly 200 are optionally reoriented and reconfigured to account for variations in fenestration assembly dimensions (e.g., space and functional requirements) while still providing the described functions including locking of each of the sashes 104, 106 with the latch blade 304, retaining of the assembly 200 in the unlocked configuration, automatic release of the assembly to the locked configuration with closing of the sashes, and further operation of the interface feature to facilitate tilting.

Figure 9:
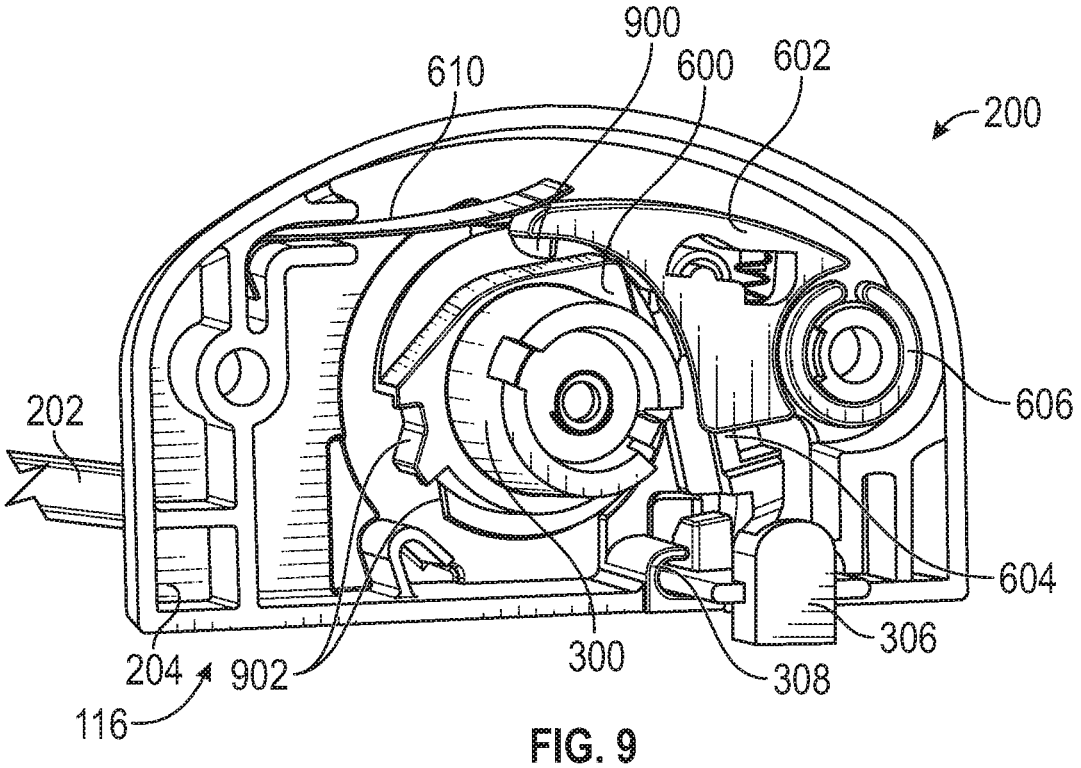
FIG. 9 is a bottom perspective view of a portion of the operator assembly of FIG. 3 with an operator interface feature in the locked position.

FIG. 9 shows a portion of the operator assembly 200 of the fenestration hardware assembly 116 in an initial or locked configuration, for instance, corresponding to the view shown in FIG. 8A. As shown in FIG. 8A, the latch blade 304 is in a deployed position relative to the operator housing 204. With the sashes 104, 106 closed, the latch blade 304 is received within the blade recess 210, for instance, shown in FIG. 7.

Referring again to FIG. 9, the underside of the operator assembly 200 is shown revealing one or more components of the operator assembly 200. The spindle 300 is coupled to the operator interface feature 202 and the operator interface feature 202 is in a position corresponding to its location in FIG. 8A. As further shown in FIG. 9, the spindle 300 includes one or more detent notches 902 configured for engagement with a corresponding detent 900 of the detent element 602. Further, the spindle 300 includes, in one example, a spindle reset 600 configured to reset the operator assembly 200, for instance, to automatically reset the release element 604 to the configuration shown in FIG. 9 (offset relative to an inline or aligned configuration shown later herein).

As further shown in FIG. 9, the detent element 602 is biased toward the spindle 300, for instance, with the detent biasing element 610 coupled with the operator housing 204 and engaged with the detent element 602 proximate to the detent 900. In other examples, a torsional spring, elastomeric biasing element or the like is provided at another portion of the detent element 602, for instance, coupled around the pivot of the detent element 602 and retained in place by the pivot clip 606.

In this configuration, the release element 604 is positioned in an offset or misaligned configuration relative to the plunger 306. Additionally, one or more components of the plunger 306 are provided at an elevated position relative to a position of the plunger while one or more of the sashes 104, 106 are open. In this configuration, at least a portion of the plunger 306 resides within a location otherwise occupied by the release element 604 while the plunger 306 is depressed (e.g., biased away from the release element) as described herein.

Figure 10A:
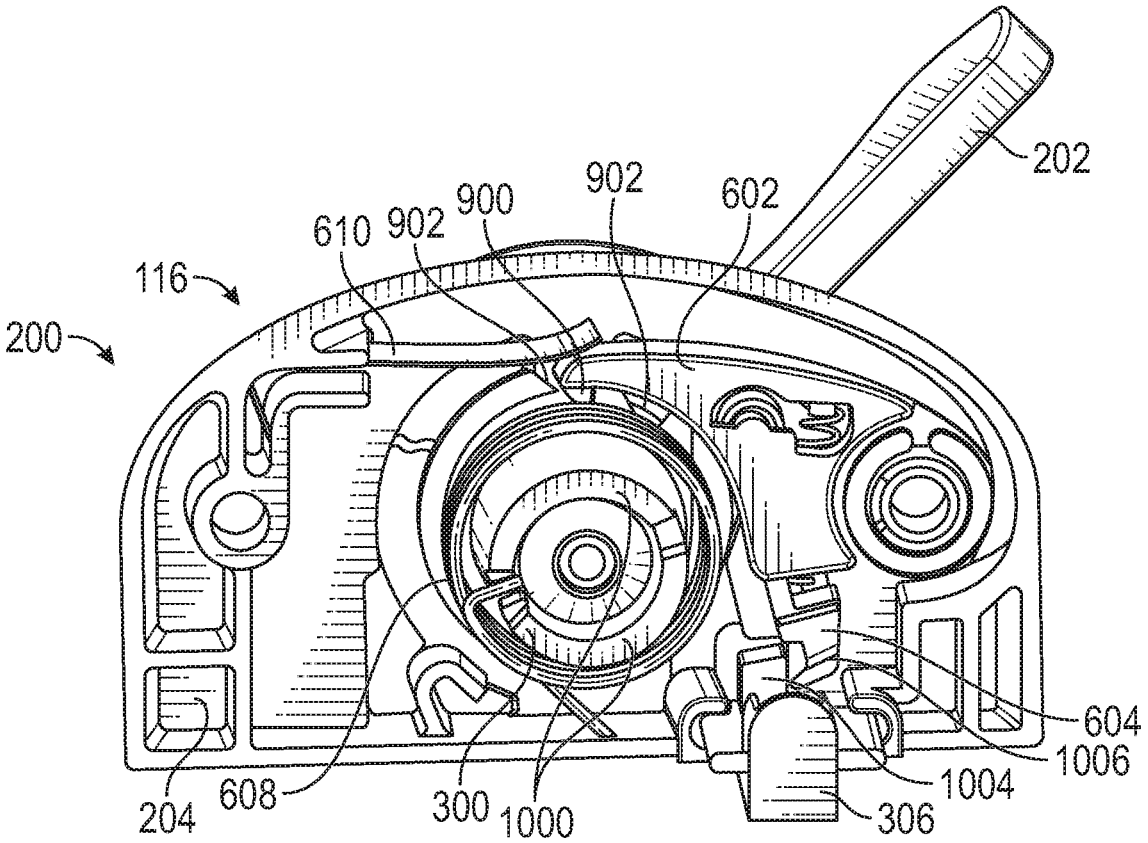
FIG. 10A is a bottom perspective view of a portion of the operator assembly of FIG. 3 with the operator interface feature in the unlocked position.
Figure 10B:
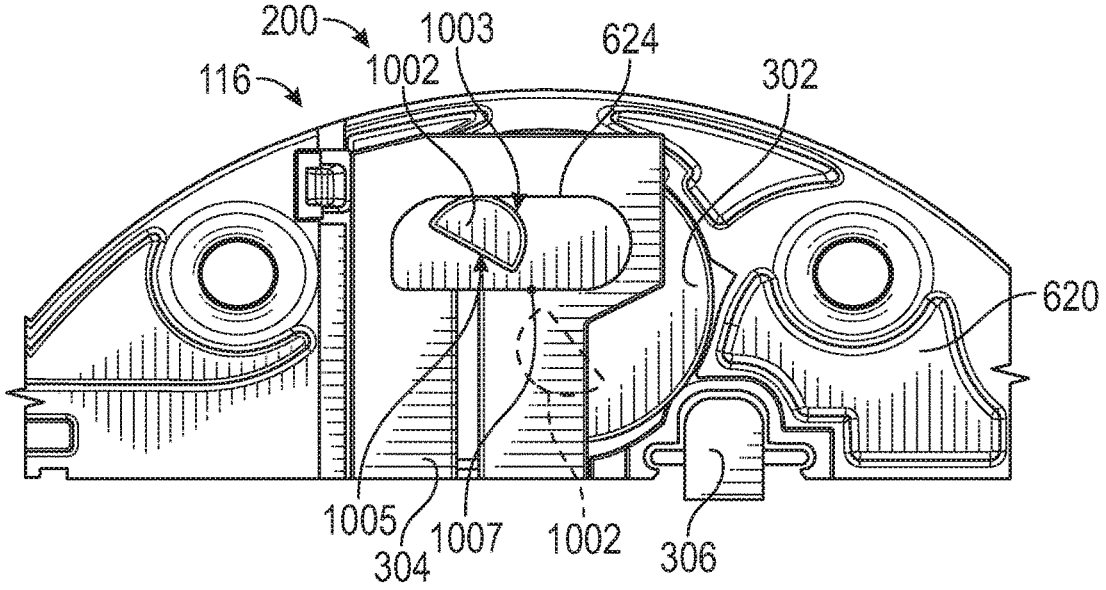
FIG. 10B is a bottom view of another portion of the operator assembly of FIG. 3 with the latch blade in a withdrawn position.

FIGS. 10A and 10B show the operator assembly 200 of the fenestration hardware assembly 116 in another configuration, for instance the unlocked configuration shown in FIG. 8B. The operator interface feature 202 is rotated relative to the operator interface feature shown in FIGS. 9 and 8A. Instead, the interface feature 202 is rotated approximately 135 degrees relative to the orientation shown in FIG. 9. With rotation of the operator interface feature 202, the spindle 300 coupled with the operator interface feature 202 is also rotated. As shown in FIG. 10A, the spindle 300 includes one or more spindle legs 1000 projecting from the spindle 300. As described herein, the spindle legs 1000 are configured for interfitting with one or more spool legs 622 to transmit rotation of the operator interface feature 202 to the spool 302 (shown in FIG. 6B) and thereby promote movement of the latch blade 304, for instance, from the deployed configuration shown in FIG. 8A to the withdrawn configuration shown in FIG. 8B (with the latch blade 304 concealed).

As further shown in FIG. 10A, the detent 900 of the detent element 602 (e.g., an example retaining mechanism) is received within one or more of the detent notches 902. Reception of the detent 900 within the detent notch 902 accordingly retains the operator interface feature 202 and the latch blade 304 in their respective unlocked positions. In one example, the operator biasing element 608 imparts a torque to the spindle 300, for instance, in a counterclockwise fashion when viewed in the orientation shown in FIG. 10A. The bias to the spindle 300 affirmatively engages the detent 900 with the corresponding surface of the detent notch 902 and thereby minimizes (e.g., eliminates or minimizes) the unseating of the detent 900 from the detent notch 902 and the spindle 300. Accordingly, the spindle 300 is reliably retained in the unlocked position shown in FIG. 10A and the latch blade 304 remains in its unlocked (withdrawn) position. Additionally, the detent biasing element 610 biases the detent 900 into affirmative engagement with the surfaces of the detent notch 902 to further enhance retention of the operator interface feature 202 and the latch blade 304 in unlocked positions (e.g., and the assembly 200 in the unlocked configuration).

As further shown in FIG. 10A, the plunger 306 remains in the position previously shown in FIG. 9. For instance, the plunger 306 is relatively elevated (when viewing the operator assembly 200 from the bottom as in FIG. 10A) and thereby resides in a position otherwise occupied by at least a portion of the release element 604 as further described herein (e.g., with opening of one or more of the sashes 104, 106).

FIG. 10B shows one or more other components of the operator assembly 200 including the spool 302 viewed from the bottom while the operator interface feature 202 is retained in the unlocked position shown in FIG. 10A. The spool 302 includes a cam 1002, such as a pin, projection, boss or the like eccentrically positioned on the spool 302 relative to a rotational axis 1007. The cam 1002 shown in FIG. 10B includes active and passive faces 1003, 1005 coupled with a cam follower 624 such as a slot, recess or the like provided in the latch blade 304.

As previously described, the spindle 300 is rotated through operation of the operator interface feature 202. Rotation of the spindle 300 is transmitted by interfitting features including, but not limited to, the spindle legs 1000 and spool legs 622 of the spool 302. The spool 302 is shown in FIG. 10B partially concealed by the latch blade 304. Rotation of the spool 302 to the position shown in FIG. 10B engages the cam 1002 (e.g., the cam active face 1003) with the cam follower 624 and withdraws the latch blade 304 into the operator housing, including a slot, recess or the like in the blade housing 310 (see FIG. 6B). A broken line representation of the cam 1002 is also shown in FIG. 10B illustrating the position of the cam 1002 with deployment of the latch blade 304. For instance, with movement of the operator interface feature 202 to the locked position (e.g., according to release of the feature 202 by way of the auto locking features described herein) the cam 1002 is moved to the position shown in broken lines. In this position, the active face 1003 of the cam 1002 biases the latch blade into the deployed configuration, for instance, for reception in the blade recess 210 shown in FIG. 7 of the blade socket 208.

As previous described, the cam 1002 optionally includes an active face 1003 and a passive face 1005. As shown in FIG. 10B, the active face 1003 is engaged with a portion of the cam follower 624. Similarly, with the latch blade 304 in the deployed position, the active face 1003 of the cam 1002 is rotated (as shown in broken lines in FIG. 10B) and correspondingly engaged with an opposed surface of the cam follower 624 to affirmatively bias the latch blade 304 into the projecting deployed position shown, for instance, in FIG. 8A.

The passive face 1005 of the cam 1002 is optionally used to minimize deployment and partial deployment of the latch blade 304. Referring again to FIG. 10A, a plurality of detent notches 902 are provided with the spindle 300. In one example, a plurality of notches 902 are provided on the spindle 300 to accordingly facilitate the capture and retention of the operator interface feature 202 in the unlocked configuration even with incomplete movement of the operator interface feature 202, for instance, to a degree measure of around 135 degrees (e.g., approximately 110 degrees). For instance, with rotation of the operator interface feature 202 to a lesser degree such as 110 degrees relative to the configuration shown in FIG. 9, the detent 900 is retained in the other detent notch 902 shown in FIG. 10A, for instance, to the right of the leftmost notch 902. Reception of the detent 900 within the second detent notch 902, for instance, corresponding to an angular position of the operator interface feature 202 less than the 135 degree position shown in FIG. 10A correspondingly positions the cam 1002 counterclockwise relative to the position shown in FIG. 10B. With a round cam, or cam 1002 without the passive face 1005, the cam having a round opposed surface at the position of the passive face 1005 engages with the opposed face of the cam follower 624 and undesirably positions the latch blade 304 in an at least partially deployed configuration. This configuration, in some examples, would promote crashing, interception and, in some examples, failure of the operator assembly 200 caused by the closing of one or more of the sashes 104, 106 with the latch blade 304 partially deployed.

Instead of a round cam, the cam 1002 having optional active and passive faces 1003, 1005 shown in FIG. 10B, positions the passive face 1005 proximate to the opposed surface of the cam follower 624 while the operator interface feature 202 is proximate to but not fully rotated to the position shown in FIG. 10A (e.g., 135 degrees). Even in this lesser angular position, the latch blade 304 is reliably withdrawn because the passive face 1005 is proximate to the opposed surface of the cam follower 624 and not otherwise engaged in a manner that biases the latch blade 304 in a manner that deploys from the housing.

Figure 11:
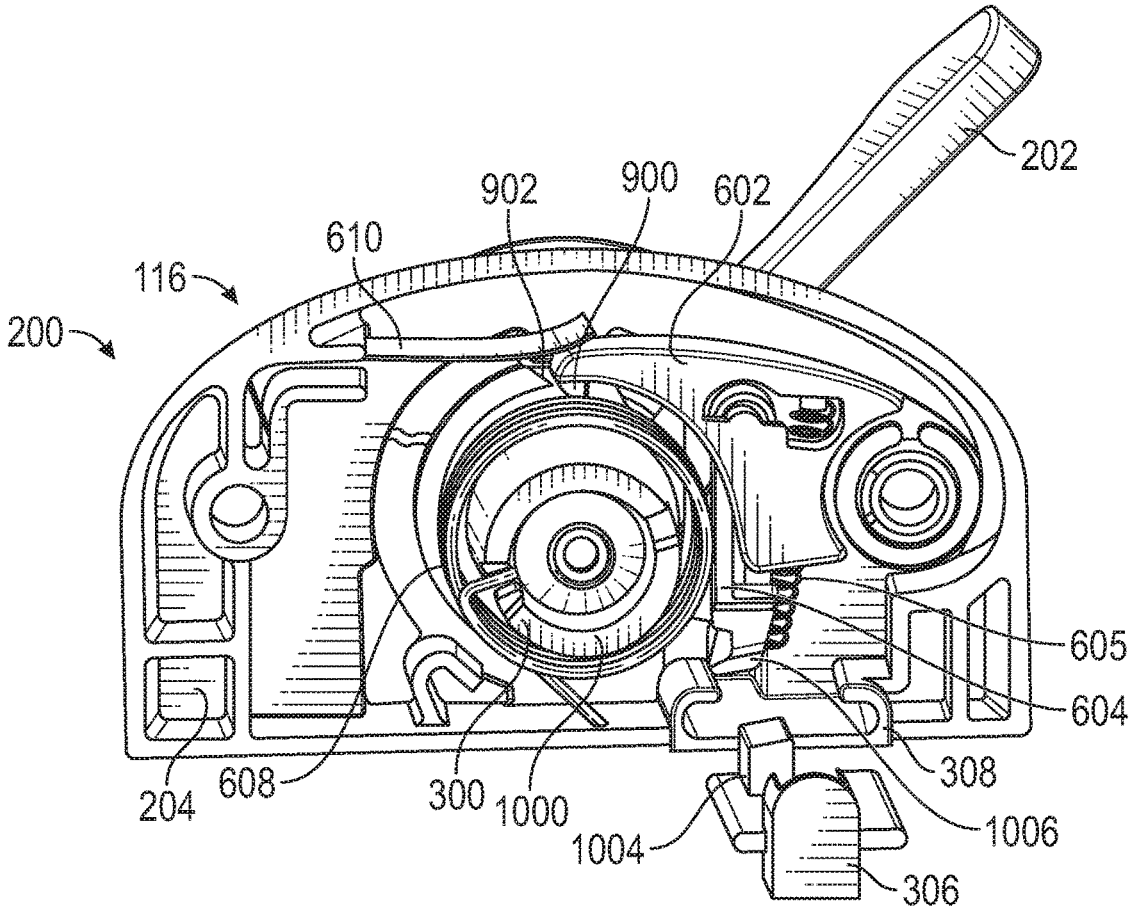
FIG. 11 is a bottom perspective view of the portion of the operator assembly of FIG. 10A with one or more sashes in an open position.

FIG. 11 shows an intermediate configuration of the operator assembly 200 with the operator interface feature 202 and the latch blade 304 in unlocked positions. In this example, the operator assembly 200 is moved relative to the position shown, for instance, in FIGS. 10A and 10B. In one example, opening of one or both of the sashes 104, 106 moves the operator assembly 200 relative to the other sash 106, 104. For instance, with raising of the lower sash 104 the operator assembly 200 is elevated relative to one or more components of the fenestration hardware assembly 116 including, for instance, the strike button 212 shown in FIG. 7. In another example, opening of the second sash 106, for instance, by lowering the second sash from the closed position toward an open position recesses the strike button 212 relative to the remainder of the operator assembly 200 on the first sash 104. As the strike button 212 and the plunger 306 are moved relatively apart, the plunger 306 is biased downward, for instance, depressed relative to the configuration previously shown in FIG. 10A. The plunger 306 is recessed away from its prior location proximate to the release element 604 (the recessed plunger 306 shown in FIG. 11 is exaggerated for illustration purposes). With the plunger 306 depressed, the release element 604 is biased by the release bias element 605 (such as a spring, elastomeric member or the like) into a position aligning the release head 1006 of the release element 604 with the plunger head 1004 of the plunger 306. In one example, the detent element 602 includes a pivot, pin or the like that rotatably couples the release element 604 to the detent element and permits rotation between the positions shown in FIGS. 10A and 11. As will be described herein, the release head 1006 remains in this aligned configuration with the plunger head 1004 until the sashes 1004, 1006 are both closed.

As further shown in FIG. 11, with depression of the plunger 306 relative to the operator assembly 200 the detent 900 remains coupled with the detent notch 902. Additionally, in this example the detent biasing element 610 and the operator biasing element 608 continue to promote the engagement of the detent 900 with the operator interface feature (e.g., the detent notches 902 on the spool 300).

Figure 12A:
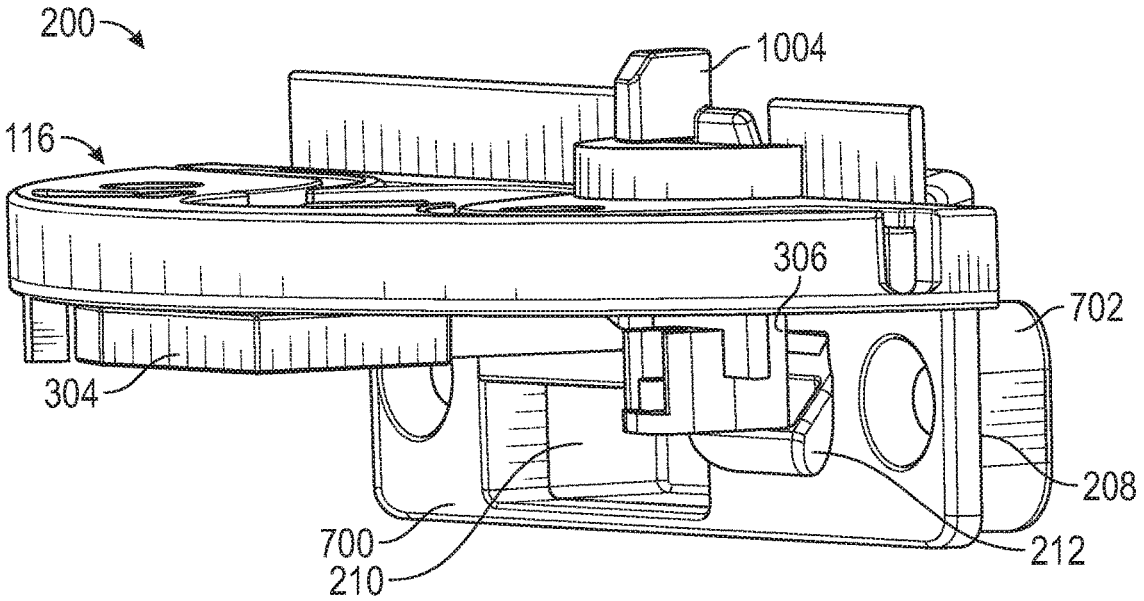
FIG. 12A is a perspective view of another portion of the operator assembly of FIG. 3 engaged with a striker with sashes in a closed position.
Figure 12B:
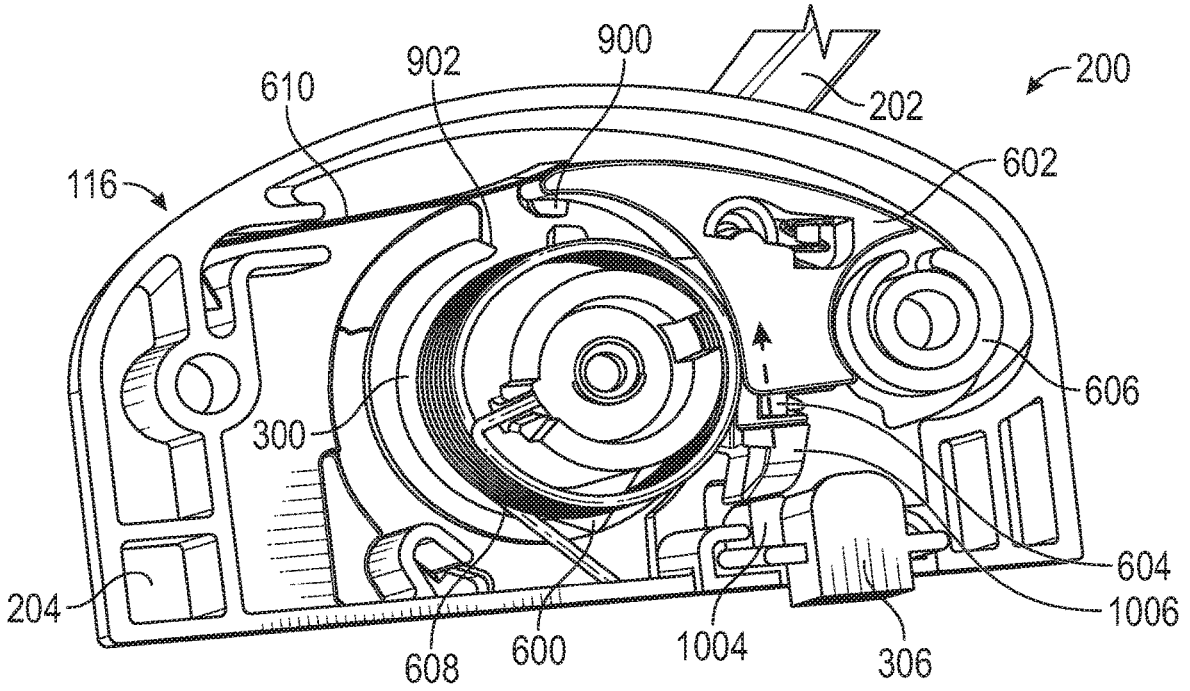
FIG. 12B is a bottom perspective view of the portion of the operator assembly of FIG. 10A with sashes in the closed position.
Figure 12C:
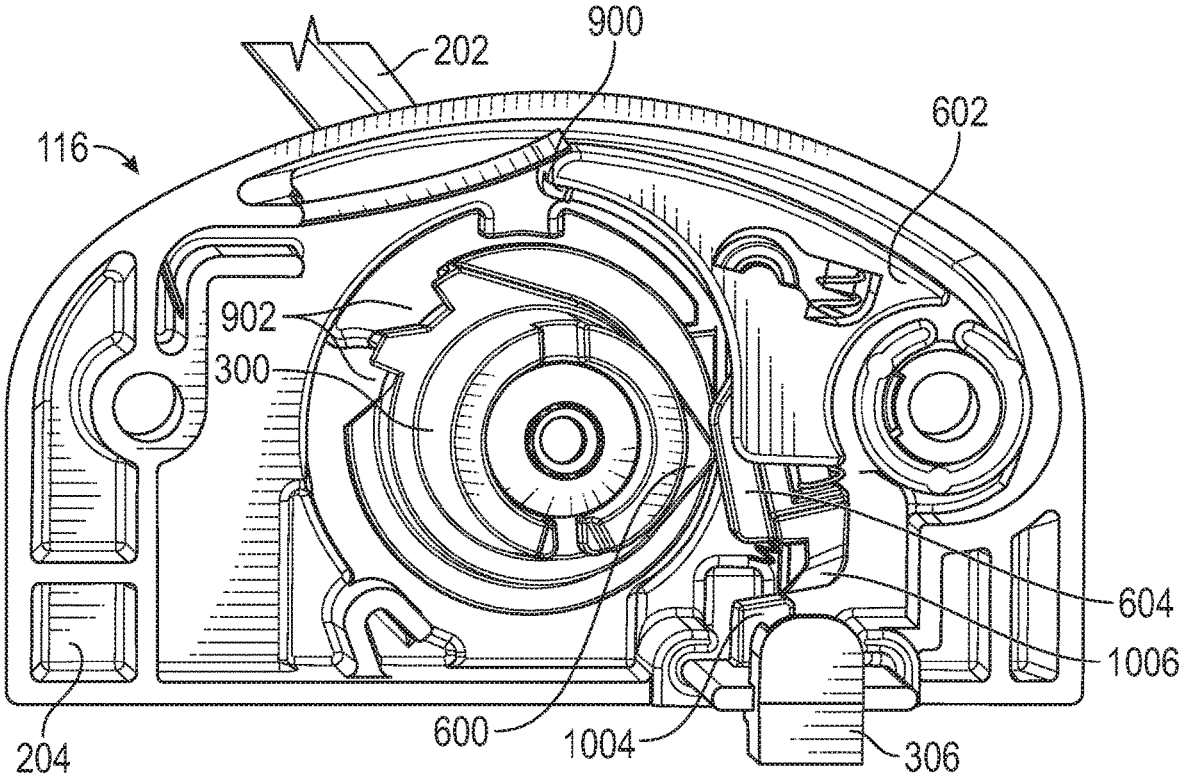
FIG. 12C is another bottom perspective view of the portion of the operator assembly of FIG. 10A with sashes in the closed position.

FIGS. 12A, 12B and 12C illustrate the operator assembly 200 in intermediate configurations during auto locking. Auto locking is initiated with closing of one or more of the sashes such as the first and second sashes 104, 106 to positions shown in FIG. 1A. Referring first to FIG. 12A, the operator assembly 200 of the fenestration hardware assembly 116 is shown in initial engagement with the strike button 212, for instance, of the blade socket 208 positioned on one of the sashes, such as the second sash 106. The strike button 212 is engaged with the plunger 306 of the operator assembly 200 (e.g., on the opposed first sash 104).

Referring now to FIG. 12B, upward movement of the plunger 306 (e.g., through engagement between the plunger and the button 212) initiates contact between the plunger head 1004 and the release head 1006 of the release element 604 (previously aligned with the plunger 306 as shown in FIG. 11). In an example, bias provided by the plunger biasing element 628 is overcome and the plunger 306 is moved and driven into the release head 1006 of the release element 604.

Because the release head 1006 is aligned with the plunger head 1004 of the plunger 306 and biased toward the aligned position upward movement of the plunger head 1004 displaces the release element 604 in a guided manner toward the detent element 602. In one example, corresponding tapered surfaces at each of the plunger head 1004 and the release head 1006 guide the engagement therebetween and further guide displacing movement of the release element 604 toward the detent element.

Movement of the release element 604 is transmitted to the detent element 602 (as shown with the dashed arrow in FIG. 12B). Movement of the release element 604 biases the detent element 602 away from the operator interface feature 202 including the detent notches 902. The detent 900 of the detent element 602 is accordingly unseated from the detent notch 902 and the operator interface feature 202 is released to rotate. The operator interface feature 202, when released, begins rotation (counterclockwise in FIG. 12B) toward the locked position according to bias provided by one or more biasing elements, such as the operator biasing element 608, latch blade biasing element (described herein) or the like. Rotation of the operator interface feature 202 including the spindle 300 is transmitted to the spool 302, and from the spool to the latch blade 304. The camming features (e.g., the cam 1002 and the cam follower 624) transform the rotation to translation of the latch blade 304, and the latch blade accordingly deploys, for instance, to the locked position shown in FIG. 8A.

Referring now to FIG. 12C, as the operator interface feature 202 begins rotation toward the locked position (as shown in FIG. 12C) the spindle 300 also rotates. As previously described, in one example, the operator assembly 200 includes a spindle reset 600, such as, a boss, projection or the like configured for engagement with one or more features of the retaining mechanism or release assembly (e.g., the release element 604). In the example shown in FIG. 12C, the spindle reset 600 rotates into engagement with the release element 604 and biases the release element 604 away from the aligned position shown in FIGS. 11 and 12B. The release element is laterally moved out of alignment with the plunger head 1004. The side of the release head 1006 engages with the side of the plunger head 1004 and is reset to the configuration shown previously, for instance, in FIG. 9. In this configuration, the operator assembly of the fenestration hardware assembly 116 is reset to a locked configuration and ready for operation again, for instance, to transition the operator interface feature 202 from the locked position (in the locked configuration of the assembly 200) to the unlocked position (in the unlocked configuration of the assembly 200), tilting configuration or the like.

With the retaining mechanism and release assembly the operator assembly 200 is configured to unlock each of the sashes 104, 106 and release the sashes for a slideable movement within the fenestration frame 102 while at the same time retaining the operator interface feature 202 in the unlocked configuration. With closing of the sashes 104, 106, the engagement between the plunger 306 and the release element 604 automatically releases the operator interface feature 202 and the latch blade 304 and allows the latch blade to deploy, for instance, into the blade recess 210 (see FIG. 7) of the closed second sash 106. Accordingly, with closing of the fenestration assembly 100, including the fenestration hardware assembly 116, the sashes 104, 106 are automatically locked by the operator assembly 200.

In another example, the operator biasing element 608 (and an optional latch blade biasing element) is absent from the fenestration hardware assembly 116 and the operator assembly 200 (of the assembly 116). In this example, as the sashes 104, 106 are closed, the plunger 306 (e.g., the plunger head 1004) engages with and moves the release head 1006 of the release element 604. As previously described, this biases the detent 900 out of the detent notches 902 and frees the operator interface feature 202 to rotate. The operator (e.g., the user) rotates the operator interface feature 202 toward the locked position (shown in FIG. 8A) to deploy the latch blade 304 into the blade recess 210 and lock the sashes 104, 106. This configuration provides the operator (user) with additional control to lock and unlock the fenestration assembly 100. For instance, the operator interface feature is released with closing of the sashes 104, 106, and with the operator biasing element 608 absent the sashes are not automatically locked. Instead, the user may reopen the sashes without having to reposition the interface feature 202 otherwise biased into the locked position. Further, because the detent element 602 remains operable (e.g., the retaining mechanism) accidental deployment of the latch blade 304 is prevented and accordingly collisions between the latch blade and the opposed sash are also prevented. Instead, upon closing the operator interface feature 202 is then freed for manual operation to deploy the latch blade 304 into the opposed blade recess 210.

In yet another example, the retaining mechanism and release assembly are absent from the fenestration hardware assembly 116 and the operator assembly 200. The operator interface feature 202, the spindle 300, the spool 302 and the latch blade 304 are included while the detent element 602, the release element 604, the plunger 306 and other associated elements are removed. In this example, the fenestration hardware assembly 116 is manually operated to transition between the locked, unlocked and tilting configurations. For instance, the operator (user) rotates the interface features 202 between each of these positions with either or both of the sashes 104, 106 in the open or closed positions. This provides additional flexibility to the operator to use the fenestration assembly 100 as desired. Further, one or more additional features are absent in this alternative configuration. For instance, the tilt stop button 212 is absent because the plunger 306 is absent in favor of manual locking.

Optionally, the tilt stop features, including the tilt top button 312, the tilt stop bar 612, tilt stop recess 618 or the like are included in either of these alternative configurations to constrain movement of the operator interface feature 202 toward the tilting position (e.g., as shown in FIG. 8C). Accordingly, the operator interface feature 202 is freely movable between the locked and unlocked positions and the fenestration assembly is accordingly transitioned between locked and unlocked configurations while transition to the tilting configuration requires additional operator input, such as depression of the tilt stop button 312.

Figure 13:
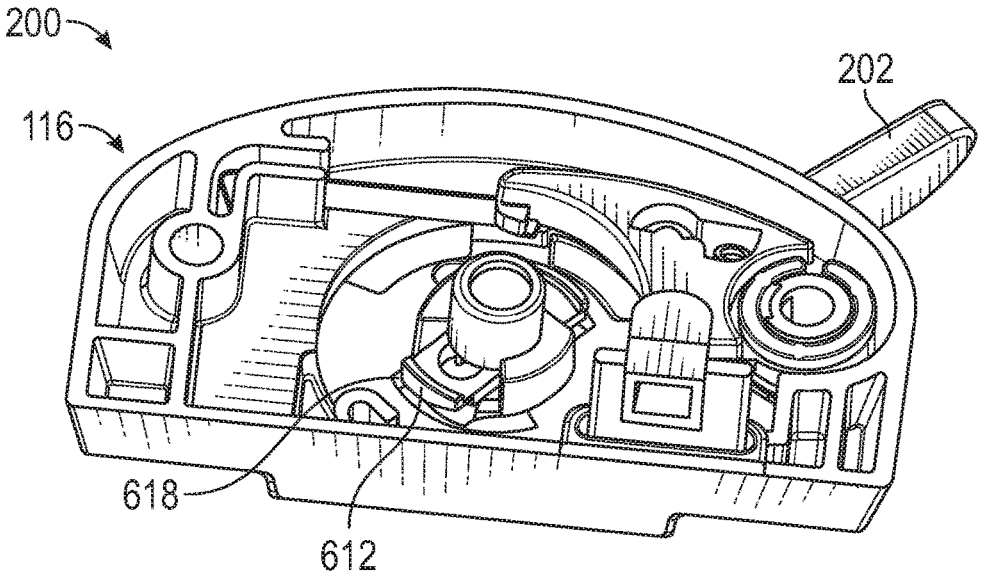
FIG. 13 is a bottom perspective view of another portion of the operator assembly of FIG. 3 with a tilt stop in a tilt preventing position.
Figure 14:
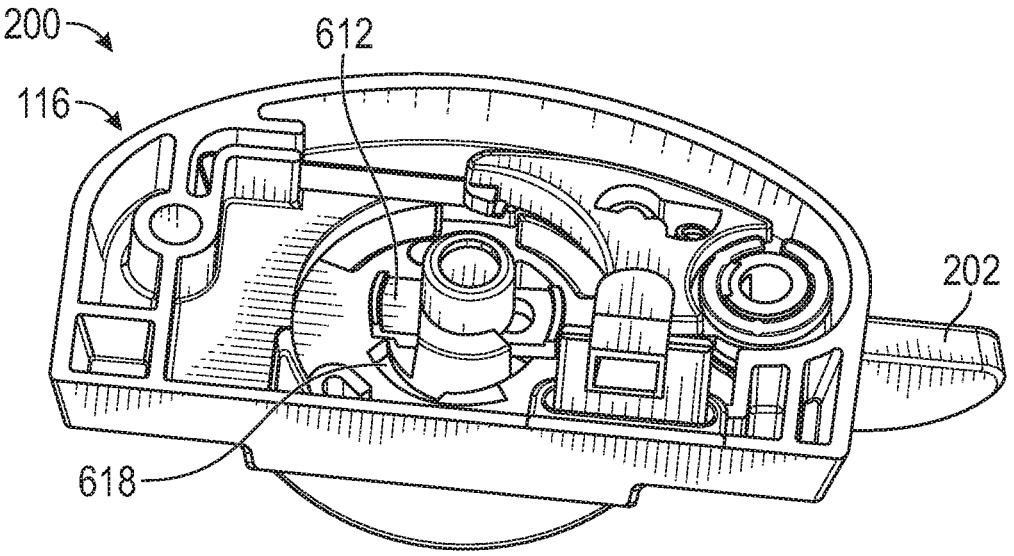
FIG. 14 is a bottom perspective view of the portion of the operator assembly of FIG. 13 with the tilt stop in a tilt permitting position.

FIGS. 13 and 14 show the operator assembly 200 of the fenestration hardware assembly 116 in the unlocked configuration and tilting configuration, respectively. As previously described, in one example, the operator assembly 200 includes one or more tilt stop features configured to prevent movement of the operator interface feature 212, for instance, into a tilting position shown in FIG. 14. One example of tilt stopping features includes the tilt stop button 312 shown in FIG. 6A (and concealed by the assembly 200 in FIG. 13) as well as the tilt stop bar 612 coupled with the tilt stop button 312, for instance, through the operator interface feature 202. As shown in the bottom view provided in FIG. 13, the tilt stop bar 612 is, in one example, received within the tilt stop recess 618. Rotation of the operator interface feature 202 beyond the unlocked position shown in FIG. 13 is prevented. The tilt stop bar 612 engages against the side walls of the tilt stop recess 618 to and prevents continued rotation of the operator interface feature 202 toward the tilting position.

Referring now to FIG. 14, when tilting of one or more of the sashes, for instance, the first sash 104 is desired, the operator depresses the tilt stop button 312 to move the tilt stop bar 612 out of alignment with the tilt stop recess 618. Once the tilt stop bar 612 is moved outside of the tilt stop recess 618, further rotation of the operator interface feature 202 is permitted. FIG. 14 shows the operator interface feature 202 rotated, for instance, 180 degrees or more relative to the initial position shown, for instance, in FIG. 8A. In this position features of the operator assembly 200, for instance the spool 302 having spool legs 622, retract the tying element 214. The retraction of the tying element 214 withdraws or retracts the latch bolts 500 of each of the latch bolt assemblies 206 from reception the latch bolt recesses 118 shown, for instance, in FIG. 1C. With the latch bolts 500 retracted, the sash (e.g., the first sash 104) is released for tilting relative to the fenestration frame 102.

Upon release of the operator interface feature 202 from the position shown in FIG. 14, the operator interface feature 202 and the spindle 300 automatically rotate toward the unlocked and locked positions. Because one or more of the operator interface feature 202, the latch blade 304, or components therebetween are biased toward the locked configuration each of the latch blade 304 and the operator interface feature 202 are moved out of the tilting positions with release of the feature 202 by the user. Because the tying elements were previously withdrawn, rotation of the spindle 300 toward the locked and unlocked positions from the tilting position releases the tying elements 214 and allows the latch bolt biasing element 504 of each of the latch bolt assemblies 206 (shown in FIG. 5) to deploy the latch bolts 500. The deploying latch bolts 500 pull the tying element 214 from the spool 302. Stated another way, the default position of the latch bolts 500 is in the deployed configuration, for instance, according to the bias provided by the respective latch bolt biasing elements 504. With release of the operator interface feature 202 shown in FIG. 14 from the tilting position the operator interface feature 202 rotates to toward the locked and unlocked positions (and is optionally held in place at the unlocked position by the detent 900 and the detent notches 902) and the latch bolts 500 redeploy, for instance, into the latch bolt recesses 118 shown in FIG. 1C.

Figure 15:
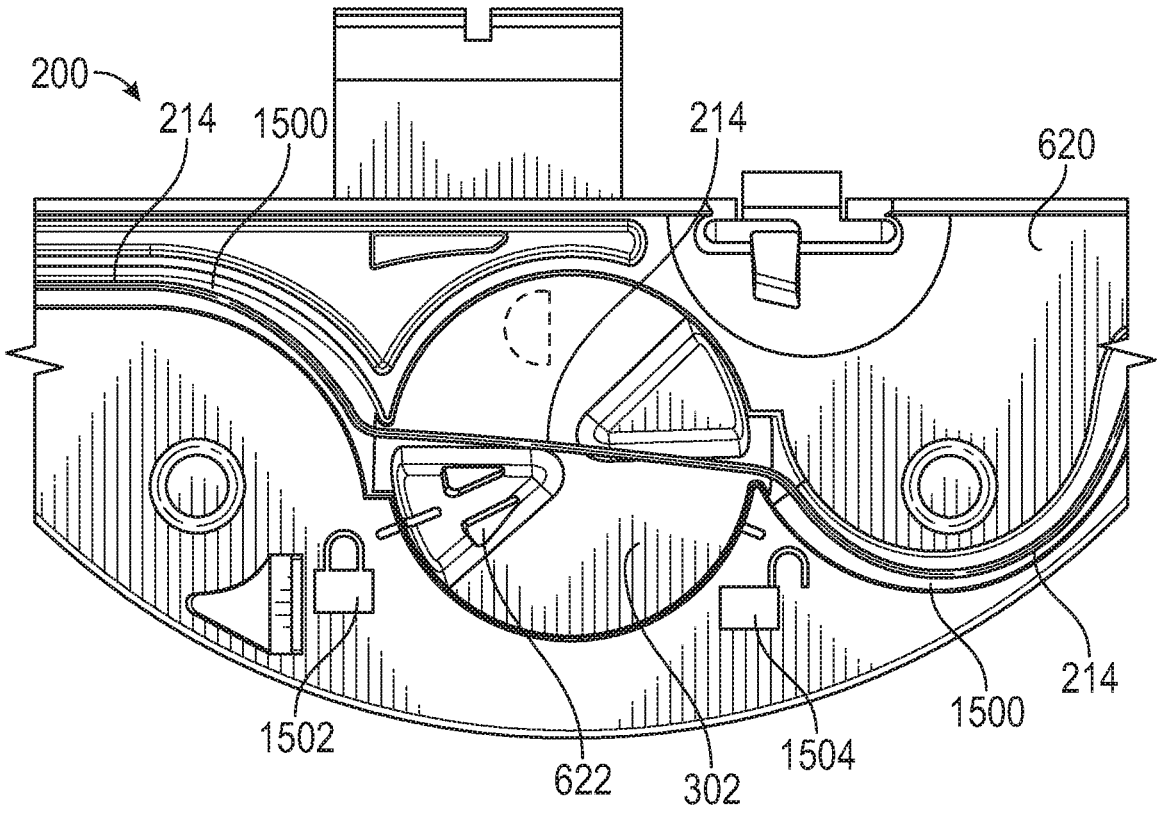
FIG. 15 is a top view of a portion of the operator interface feature in a locked configuration having a spool in a passive zone.
Figure 16:
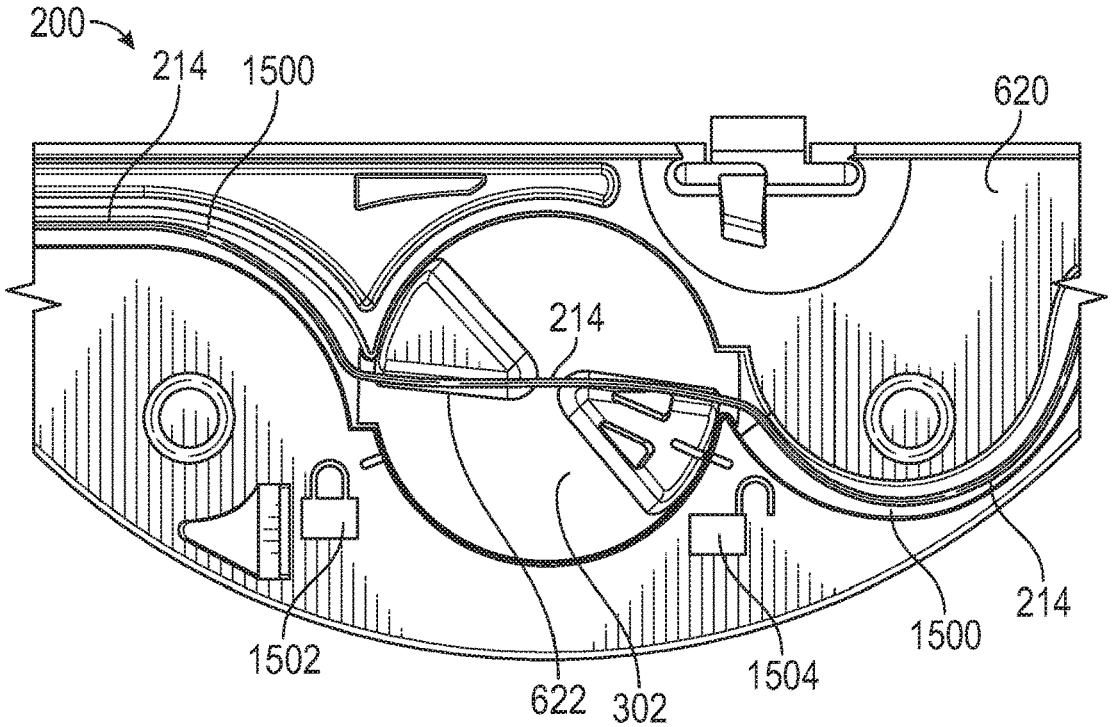
FIG. 16 is a top view of the portion of the operator interface feature of FIG. 15 in an unlocked configuration having the spool in the passive zone.
Figure 17:
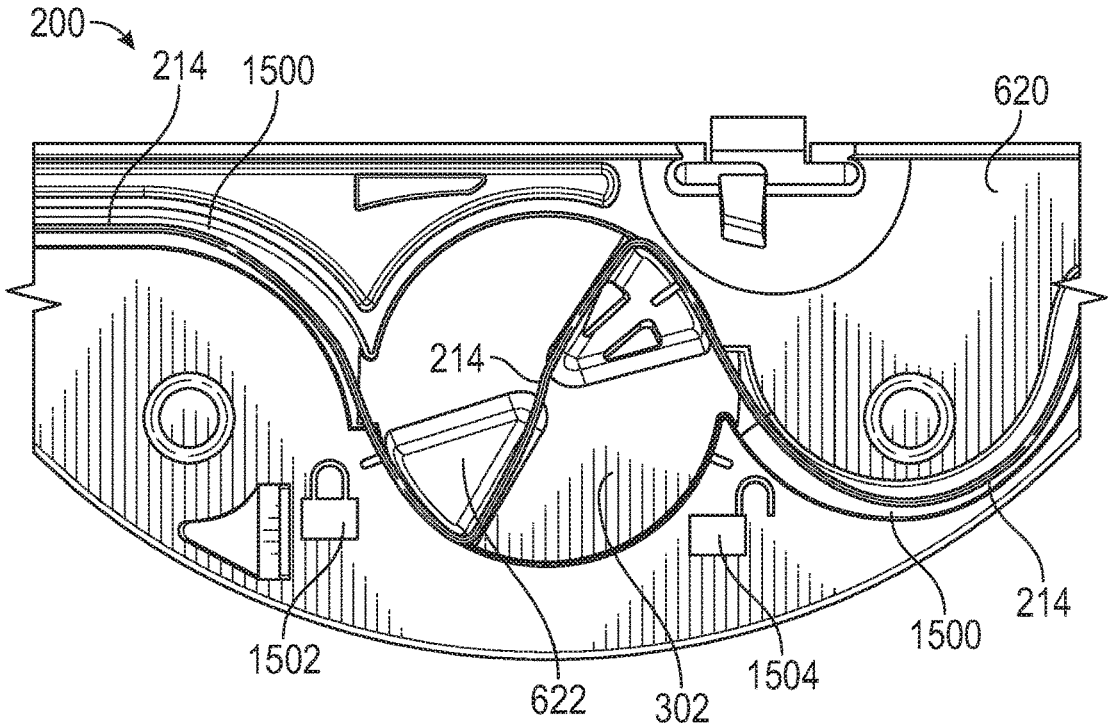
FIG. 17 is a top view of the portion of the operator interface feature of FIG. 15 in a tilting configuration having the spool in a wrapping zone.

FIGS. 15, 16 and 17 show the operator assembly 200 including the spool 302 in each of the locked configuration, the unlocked configuration and the tilting configuration, respectively. The spool 302 including the example spool legs 622 is shown coupled with the tying element 214 in each of these configurations.

Referring first to FIG. 15, the spool 302 is shown in a locked position, for instance, corresponding to the position of the operator interface feature 202 shown in FIG. 8A. In this position, the tying element 214 extends through the operator assembly 200 (e.g., through the guide housing 620) and the spool 302, and the tying element is positioned between the spool legs 622. As further shown in FIG. 15, the tying element 214 is received in element channels 1500 that guide the tying element 214 while moved (during retraction and deployment). As further shown in FIG. 15, the tying element 214 extends between the spool legs 622 and is passively engaged with the spool legs 622 and not wrapped around the spool 302 or the spool legs 622 in a manner that would retract the latch bolts. Accordingly, one or more of the sashes 104, 106 remains held within the fenestration frame 102 of the fenestration assembly and is prevented from tilting.

Referring now to FIG. 16, the spool 302 is shown in a position corresponding to the unlocked configuration shown in FIG. 8B. In this example, the spool 302 is rotated counterclockwise relative to the position shown in FIG. 15. The spool legs 622 are rotated approximately 135 degrees corresponding to the rotation of the operator interface feature 202. As shown, the tying element 214 is in a substantially identical configuration to the configuration shown in FIG. 15. The spool legs 622 are rotated around the tying element 614 and because of the positioning of the spool legs 622 and the orientation of the tying element 214 (e.g., with the element channels 1500) the tying element 214 remains passively engaged by the spool legs 622 and is not wrapped by the spool 302 to retract the latch bolts. In the unlocked configuration, like the locked configuration, the tying element 214 remains in its unwrapped configuration with only incidental retraction that does not trigger retraction of the latch bolts into, for instance, one or more of the first or second sashes 104, 106. Movement of the operator interface feature 202, the spool 302 and the like within this passive zone (e.g., between the locked and unlocked positions) thereby does not release the sashes for tilting.

As further shown in FIGS. 15 and 16, the guide housing 620, in one example, includes a locked indicator 1502 and an unlocked indicator 1504. In one example, rotation of the spool 302 moves a corresponding indicator, such as a hash mark, between each of the locked and unlocked indicators 1502, 1504. In one example, the corresponding portion of the operator housing 202 is removed to reveal these components and allow the user to confirm positioning of the spool 302 in each of the locked and unlocked positions. In another example, the guide housing 620 includes the locked indicator 1502 and the unlocked indicator 1504 to facilitate installation of the spool 302 in the correct orientation at assembly of the operator assembly 200. For instance, the spool 302 includes the hash element on one of the spool legs 622 aligned with the locked indicator 1502 on the guide housing 620 for initial installation of the spool. With the spool legs 622 aligned with the locked indicator 1502, the tying element 214 is then passed through the guide housing 620 (e.g., including the element channels 1500) and between the spool legs 622 in the configuration shown in FIG. 15.

FIG. 17 shows the spool 302 in a position corresponding to the tilting configuration of the operation assembly 200, for instance, with the operator interface feature 202 positioned as shown in FIG. 8C. In this position, the spool 302 is moved beyond the passive engagement with the tying element 214. Here, the spool legs 622 are actively engaged with the tying element 214 and wrap the tying element around and between the spool legs 622 as shown. Accordingly, the tying element 214 is drawn into the guide housing 620. The element channels 1500 guide the tying element 214 toward the spool legs 622 and ensure the spool legs 622 readily wrap the tying element 214 thereon without binding, coiling, knotting or the like. As the operator interface feature 202 and the spool legs 302 move beyond the unlocked configuration toward the tilting configuration, the spool legs 622 actively engage with the tying element 214 and wrap the tying element there around. Accordingly, the latch bolts 500 of each of the latch assemblies 206 are withdrawn into their respective latch bolt housings 502 and free the respective sash, such as the first sash 104, to tilt relative to the fenestration frame 102 as shown, for instance, in FIG. 1C. While the spool 302 (e.g., the spool legs 622) are engaged with the tying element 214 and wrapping the tying element, the operator interface feature 202, the spool 302 and the like are within a wrapping zone in contrast to the previously described passive zone having no wrapping or retraction of the tying element 214.

With release of the operator interface feature 202, for instance, in the position shown in FIG. 8C, as previously described herein, the interface feature 202 is biased from the tilting position toward the unlocked and locked positions. Accordingly, the operator interface feature 202 rotates toward the unlocked and locked configurations as does the spool 302. With rotation of the spool 302, for instance, toward the unlocked configuration shown in FIG. 16, the tying element 214 is unwrapped from the spool legs 622. Because of the bias provided to the tying element 214, for instance, by the latch bolt assemblies 500 and the latch bolt biasing elements 504 provided therein, the tying element 214 remains taut as it is pulled from the guide housing 620. Accordingly, coiling, binding, slack and the like are prevented in the operator assembly 200 as the tying element 214 is unwound.

Figure 18:
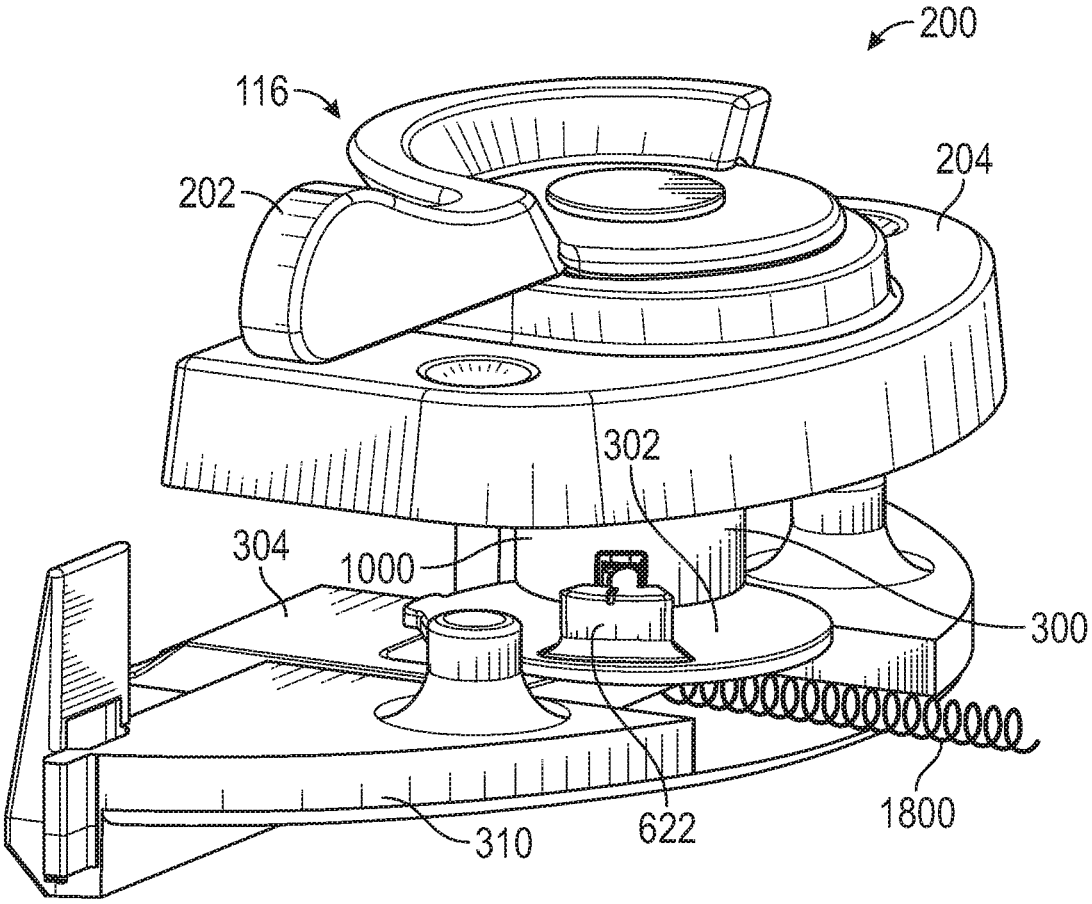
FIG. 18 is a perspective view of another example of an operator assembly including a latch blade and operator interface feature biasing element.

FIG. 18 shows another example of the operator assembly 200 including an alternative configuration of a biasing element configured to bias the operator interface feature 202 toward the locked configuration. In this example, the operator assembly 200 includes a latch blade biasing element 1800 coupled between the latch blade 304 and one or more portions of the operator housing 204 or a portion of the fenestration assembly 100 including, for instance, a wall of a recess in the check rail 114 (shown in FIG. 1A) configured to receive the operator assembly 200 therein.

Referring again to FIG. 18, the spindle 300 is coupled with the operator interface feature 202 as previously described. The spindle 300 is coupled with the spool 302, for instance, by the interfitting spindle legs 1000 and spool legs 622. Rotation of the operator interface feature 202 is transmitted to the latch blade 304 from the spool 302 by, in an example, the previously described cam 1002 and cam follower 624. As previously described, a biasing element is, in one example, coupled with the spindle 300 and configured to bias the operator interface feature 202 toward the locked configuration. Additionally, because of the coupling between the interface feature 202 and the latch blade 304, the latch blade 304 is similarly biased toward a deployed position, for instance, the deployed position shown in FIG. 18.

In another example, the latch blade biasing element 1800 is provided with the latch blade 304 whether alone or in combination with the spindle biasing element previously described herein. As shown, the latch blade biasing element 1800 is configured to bias the latch blade 304 toward the deployed position corresponding to the locked configuration of the fenestration hardware assembly 116. In a manner similar to the spindle biasing element, the latch blade biasing element 1800 moves the cam 1000 and cam follower 624 and accordingly rotates the spool 302. Rotation of the spool 302 is transmitted to the spindle 300 and correspondingly transmitted to the operator interface feature 202. Accordingly, the operator assembly 200, in another example, includes one or more of biasing of the operator interface feature 202 and the latch blade 304 with the latch blade biasing element 1800, the spindle biasing element 608 previously described herein, both of these biasing elements or the like.

Figure 19:
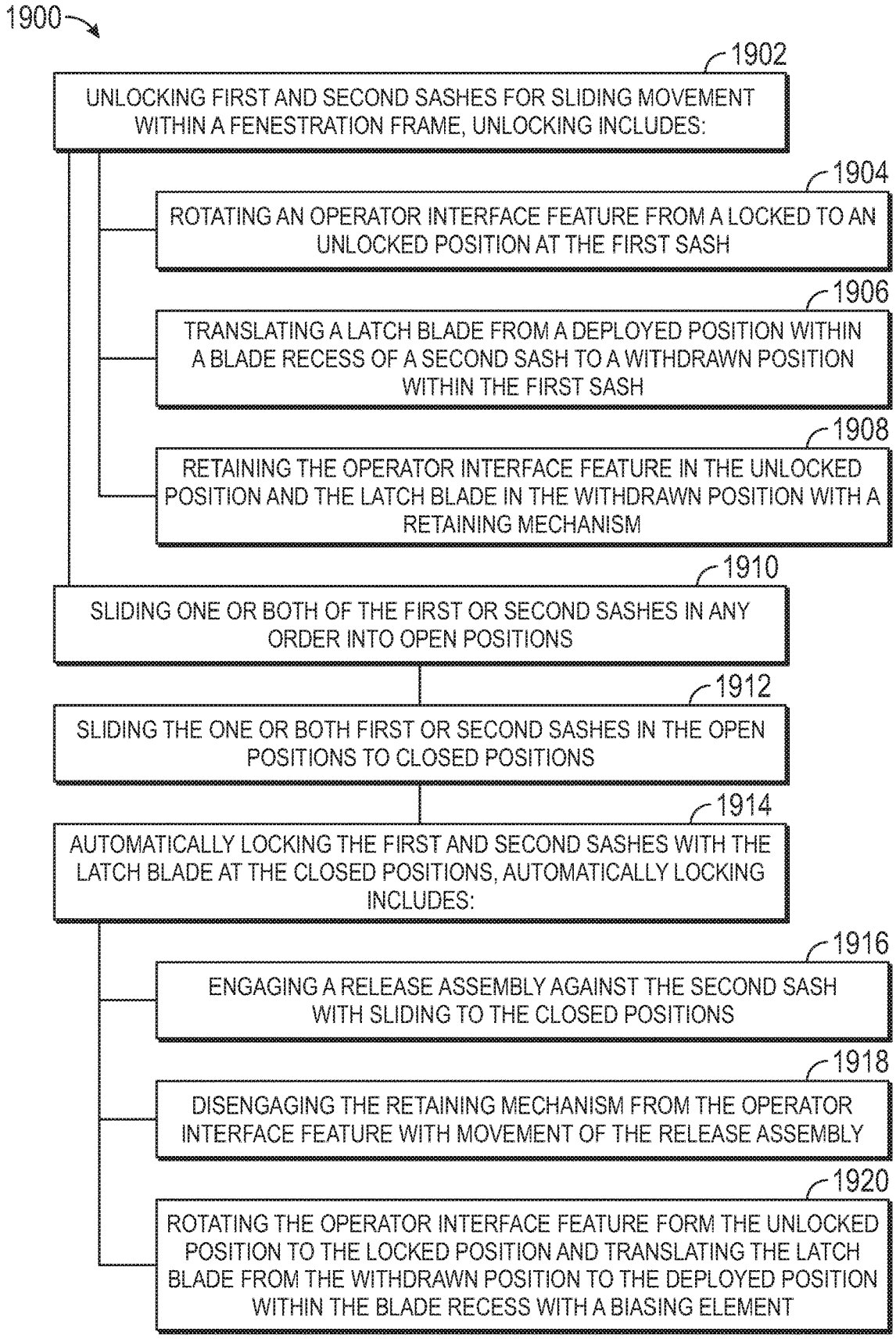
FIG. 19 is a block diagram showing one example of a method for using a fenestration assembly.

FIG. 19 shows one example of the method 1900 for using a fenestration assembly, such as the assembly 100 shown in FIGS. 1A, 1B and 1C. In describing the method 1900 reference is made to one or more components, features, functions, steps or the like described herein. Where convenient, reference is made to the components, features, functions, steps or the like with reference numerals. Reference numerals provided are exemplary and are not exclusive. For instance, the components, features, functions, steps or the like described in the method 1900 include, but are not limited to, corresponding numbered elements, other corresponding features described herein both numbered and a number as well as their equivalents.

At 1902 the method 1900 includes unlocking first and second sashes. For instance, the sashes 104, 106 shown in FIG. 1A within a fenestration frame 102. In one example, unlocking the first and second sashes includes at 1904 rotating the operator interface feature 202 from a locked position to an unlocked position, for instance, at the first sash 104. As shown in an example in FIG. 1A, a portion of the fenestration hardware assembly 116 including for instance the operator assembly 200 shown in FIG. 2 is coupled with the fenestration assembly 100 at the sash check rail 114 of the first sash 104. In one example at 1906, unlocking the first and second sashes further includes translating a latch blade, such as the latch blade 304 shown in FIG. 3 from a deployed position within a blade recess (e.g., blade recess 210 shown in FIG. 2) to a withdrawn position within the first sash 104. At 1908 the method 1900 further includes retaining the operator interface feature 202, for instance a lever, handle, slide or the like, in the unlocked position and the latch blade 304 in the withdrawn position with a retaining mechanism. The retaining mechanism includes one or more features such as a detent, detent notches provided with the operator interface feature 202 (e.g., with the spindle 300 coupled with the operator interface feature 202) or the like.

At 1910 the method 1900 further includes sliding one or both of the first or second sashes 104, 106 in any order into open positions (including opening one of the sashes and not the other). For instance, the method 1900 includes sliding the first sash 104 into an open position, sliding the second sash 106 into an open position before the first sash or sliding one or both of the first or second sashes in any order. Accordingly, the fenestration hardware assembly 116 described herein is configured to unlock and remain unlocked with any permutation of opening of one or both of the first or second sashes 104, 106, including leaving one or more of the first or second sashes 104, 106 in the closed position.

The method 1900 further includes at 1912 sliding one or both of the first or second sashes previously positioned in the respective open positions to closed positions. In one example, sliding either or both of the first or second sashes to the closed positions includes sliding one of the first or second sashes to the closed position, for instance, where the opposed sash is already in the closed position.

At 1914 the method 1900 further includes automatically locking the first and second sashes 104, 106 with the latch blade 304 while the sashes are at the closed positions. In one example, automatically locking the first and second sashes includes engaging a release assembly against the second sash 106 with sliding of either or both in the first or second sashes 104, 106 to the closed positions. At 1918, the retaining mechanism, for instance one or more of detent, detent element engaged with one or more detent notches as described herein, is disengaged from the operator interface feature 202. For instance, the retaining the detent element 602 is disengaged from the spindle 300 of the feature 202 with movement of the release assembly including, but not limited to, one or more of a plunger 306, release element 604 or the like. Disengagement of the retaining mechanism from the operator interface feature 202 includes movement of the release assembly initiated, in one example, by the engagement of the release assembly against a component of the second sash (e.g., the strike button 212) with sliding movement of one or more of the sashes 104, 106 to the closed position.

At 1920, automatically locking the first and second sashes 104, 106 further includes rotating the operator interface feature 202 from the unlocked position, for instance, from the unlocked position shown in FIG. 8B to the locked position shown in FIG. 8A. Additionally, automatically locking the first and second sashes includes in another example translating the latch blade 304 from the withdrawn position to the deployed position. One example of the deployed position is shown in FIG. 4.

As described herein, rotating of the operator interface feature 202 from the unlocked position to the locked position and translating of the latch blade 304 from the withdrawn position to the deployed position within the blades recess is trigged through the automatic operation of the fenestration hardware assembly 116 initiated by closing of the first or second sashes 104, 106. For instance, in one example of the release assembly is moved by the closing operation and accordingly transmits movement to the retaining mechanism to unseat the retaining mechanism and release the operator interface feature 202. Optionally a biasing element coupled with one or more of the operator interface feature, the latch blade or the like is configured, with freeing of the operator interface feature 202, to rotate the interface feature 202 toward the locked position and deploy the latch blade deployed position. Because deployment of the latch blade is initiated with closing of the sashes 104, 106 the latch blade 304 is automatically deployed into the blade recess 201 of the closed second sash 106 and the sashes are locked.

Several options for the method 1900 follow. In one example, retention of the operator interface feature 202 includes biasing a detent, for instance the detent element 602 including the detent 900 shown in FIGS. 9 and 10A, into one or more detent notches 902 of the operator interface feature 202. As previously described the operator interface feature 202 in an example incudes a feature, such as a spindle 300, coupled with the remainder of the operator interface feature 202. In another example, disengaging the retaining mechanism, such as the detent element 602, with movement of the release assembly includes moving the plunger 306, for instance through engagement with the second sash 106 (e.g., the strike button 212 shown in FIGS. 2 and 7). Movement of the plunger 306 moves the release element 604 and movement to the release element by way of the plunger moves the detent 900 out of one or more of the detent notches 902.

In another example, sliding one or both of the first or second sashes 104, 106 includes deploying the plunger 306 of the release assembly from the first sash 104 according to sliding movement of one or more of the first or second sashes relative to the other of the second or first sashes. For instance, in one example the plunger 306 includes a plunger biasing element 628 as shown in FIG. 6B. With movement of either or both the second sash 106 or the first sash 104 toward open positions the plunger 306 is disengaged with the strike button 212 of the opposed second sash 106. The plunger biasing element 628 biases the plunger 306 away from the remainder of the operator assembly 200. In one example, movement of the plunger 306 projects the plunger 306 away from one or more components of the sash 104 and accordingly exposes the plunger 306 for engagement with the second sash 106 upon closing of the first or second sashes 104, 106. In another example, for instance shown in FIG. 11, deployment of the plunger 306 includes aligning the plunger head 1004 with the release element 604. As shown in FIG. 11 with depression of the plunger 306 away from the remainder of the operator housing 204, a release head 1006 of the release element 604 is aligned with the plunger head 1004. In one example, a release biasing elements 605 coupled between the operator housing 204 and the release element 604 or between the operator housing 204 and the release element 604 biases the release element 604. In another example, sliding one or both of the first or second sashes 104, 106 in the respective open positions to closed positions as previously described herein and engaging the release assembly against the second sash 106 includes engaging the release assembly (e.g., the plunger 306) against the second sash. For instance, engaging the plunger 306 with the second sash 106 and depressing the plunger 306 to move the release element aligned with the previously depressed plunger 306 toward the detent element 602. Movement of the detent element 602 with the moved released element 604 unseats the detent 900 from one or more detent notches 902 provided with the operator interface feature 202, for instance along the spindle 300.

In an additional example, the method 1900 further includes transitioning at least the first sash 104 to a tilting configuration. In one example, transitioning of the first sash 104 (or optionally a second sash 106) includes rotating the operator interface feature 202 from the unlocked position, for instance shown in FIG. 8B, to a tilting position shown, for instance, in FIG. 8C. A tying element 214 is wrapped around a portion of the operator interface feature 202. Wrapping of the tying element around the portion of the operator interface feature withdraws one or more latch bolts 500 from one or more corresponding latch bolt recesses 118 shown, for instance, in FIG. 1C. Withdrawal of the latch bolts 500 from the latch bolt grooves 118 frees the sash, for instance the first sash 104 (or in another configuration the second sash 106), to tilt relative to the fenestration frame 102. One example of the tilting configuration is shown in FIG. 1C. In one example, the operator interface feature 202 includes a spool 302 having a wrapping zone. In one example, the wrapping zone corresponds to a portion of the rotation range of the spool 302 relative to rotation between the locked configuration, unlocked configuration and the tilt configuration. While the spool 302 is moved within the wrapping zone, the tying element 214 is wrapped around one or more components of the spool 302 (e.g., spool legs). In another example, the spool 302 includes a passive zone, for instance corresponding to rotation of the spool 302 between the locked and unlocked configurations shown in FIGS. 15 and 16. In the passive zone, the tying element 214 remains in an unwound configuration while the spool 302 is otherwise rotated toward the unlocked configuration or the locked configuration depending on the rotational direction within the passive zone. Conversely after the spool 302 transitions out of the passive zone with continued rotation of the operator interface feature 202 toward the tilting configuration the spool 302 moves into the wrapping zone and one or more elements such as the spool legs 622 shown in FIG. 17 wrap the typing element 214 there along and accordingly draw the tying element through one or more element channels 1500 to withdraw the latch bolts 500 from the corresponding latch bolt recesses 118.

In yet another example, rotating the operator interface feature 202 from the unlocked position to the locked position and translating the latch blade 304 from the withdrawn position to the deployed position within the blade recess 210 shown in FIGS. 2 and 7 includes biasing the latch blade 304 with a blade biasing element, for instance the element 1800 shown in FIG. 1800. In this example, bias supplied to the latch blade 304 is transmitted by way of one or more cam features to the spool 302 and the spindle 300 and from the spindle 300 to the operator interface feature 202. Accordingly, bias of the latch blade 304 is transmitted to the remainder of the operator interface feature 202 including the handle projecting from the operator housing 204 to transition the operator interface feature 202 from the unlocked configuration toward the locked configuration. In still another example, an operator biasing element 608, for instance a torsion spring or the like, is coupled with the operator interface feature 202 in contrast to the latch blade 304. The operator biasing element 608 provides a bias to the operator interface feature 202 (e.g., the spindle 300). The bias provided by the operator biasing element 608 in a similar manner to the latch blade biasing element 1800 previously described herein also rotates the operator interface feature 202 (when free for instance by way of disengagement of the detent element 602 from one or more detent notches 902) toward the locked position. Bias provided from the operator biasing element 608 is transmitted through the spindle 300 to the spool 302 and from the spool 302 to the latch blade 304 (with the camming features) to accordingly translate the latch blade toward the deployed position configured to lock the sashes 104, 106. In still other examples, one or both of the operator biasing element 608 and the latch blade biasing element 1800 are used alone or in combination to accordingly bias the operator assembly 200 toward the locked configuration. The bias of the operator assembly 200 toward the locked configuration is used in combination with operation of the release assembly including the plunger 306, the release element 604 and the retaining mechanism including the detent element 602 and one or more detent notches 902 provided with the operator interface feature 202 to accordingly initiate auto locking with closing of the sashes 104, 106.

VARIOUS NOTES & EXAMPLES

Example 1 can include subject matter, such as a fenestration hardware assembly comprising: a blade socket including a blade recess; an operator interface feature rotatably coupled with an operator housing; a latch blade movably coupled with the operator housing, the latch blade is movable between deployed and withdrawn positions, in the deployed position at least a portion of the latch blade is received in the blade recess of the blade socket, and in the withdrawn position the portion of the latch blade is recessed from the blade recess; and wherein the operator interface feature is rotatable between at least locked and unlocked configurations, in the locked configuration the latch blade is in the deployed position and received in the blade recess, and in the unlocked configuration the latch blade is translated from the deployed position to the withdrawn position and withdrawn from the blade recess according to rotation of the operator interface feature.

Example 2 can include, or can optionally be combined with the subject matter of Example 1, to optionally include wherein the latch blade is configured for reciprocating movement between the withdrawn and deployed positions.

Example 3 can include, or can optionally be combined with the subject matter of one or any combination of Examples 1 or 2 to optionally include wherein the operator interface feature includes a rotation axis and an eccentric cam spaced from the rotation axis, and the latch blade includes a cam follower coupled with eccentric cam.

Example 4 can include, or can optionally be combined with the subject matter of one or any combination of Examples 1-3 to optionally include wherein the eccentric cam includes a pin, and the cam follower includes a slot, the pin received with the slot.

Example 5 can include, or can optionally be combined with the subject matter of one or any combination of Examples 1-4 to optionally include wherein the eccentric cam includes a pin having an active face and a passive face, and the active face is configured to engage with the cam follower and translate the latch blade from the deployed position toward the withdrawn position, and the passive face is configured for recessing from the cam follower and maintaining the latch blade in the withdrawn position.

Example 6 can include, or can optionally be combined with the subject matter of Examples 1-5 to optionally include wherein the latch blade is configured for coupling with a first sash at a first location remote from edges of the sash configured for sliding movement along a fenestration frame, and the blade socket is configured for coupling with a second sash at a second location opposed to the first location.

Example 7 can include, or can optionally be combined with the subject matter of Examples 1-6 to optionally include the first and second sashes, the latch blade is coupled with the first sash near a midpoint of a first sash check rail, and the blade socket is coupled with the second near a midpoint of a second sash bottom rail.

Example 8 can include, or can optionally be combined with the subject matter of Examples 1-7 to optionally include at least one latch bolt assembly having a latch bolt movable between a withdrawn tilting position and a deployed static position; a tying element coupled between the latch bolt and the operator interface feature; and wherein the operator interface feature is rotatable between the unlocked configuration and a tilting configuration, and in the tilting configuration the latch bolt is in the withdrawn tilting position according to rotation of the operator interface feature toward the tilting configuration.

Example 9 can include, or can optionally be combined with the subject matter of Examples 1-8 to optionally include wherein the operator interface feature includes a spool having passive and wrapping zones, in the passive zone the spool is disengaged from the tying element with rotation of the operator interface feature between locked and unlocked configurations, and in the wrapping zone the spool is engaged with the tying element and rotation of the operator interface feature from the unlocked configuration toward the tilting configuration wraps the tying element around the spool.

Example 10 can include, or can optionally be combined with the subject matter of Examples 1-9 to optionally include a retaining mechanism configured to retain the operator interface feature in the unlocked configuration and the latch blade in the withdrawn position.

Example 11 can include, or can optionally be combined with the subject matter of Examples 1-10 to optionally include wherein the retaining mechanism includes: one or more detent notches coupled with the operator interface feature, and a detent element movably coupled with the operator housing, the detent element is biased toward the one or more detent notches, and reception of the detent element in the one or more detent notches retains the operator interface feature in the unlocked configuration and the latch blade in the withdrawn position.

Example 12 can include, or can optionally be combined with the subject matter of Examples 1-11 to optionally include a release assembly coupled with the operator housing, the release assembly is configured to disengage the retaining mechanism and release both the latch blade to move into the deployed position and the operator interface feature to return to the locked configuration with closing of first and second sashes.

Example 13 can include, or can optionally be combined with the subject matter of Examples 1-12 to optionally include wherein the release assembly includes: a plunger movably coupled with the operator housing, a release element coupled with the retaining mechanism, and the plunger is configured to move the release element with closing of the first and second sashes, the moved release element is configured to disengage the retaining mechanism.

Example 14 can include, or can optionally be combined with the subject matter of Examples 1-13 to optionally include wherein the operator interface feature includes a reset boss configured to bias the release element out of alignment with the plunger and reengage the retaining mechanism with the operator interface feature with return of the operator interface feature to the locked configuration.

Example 15 can include, or can optionally be combined with the subject matter of Examples 1-14 to optionally include wherein the release assembly includes: a floating strike button coupled with the blade socket, and a strike biasing element configured to bias the floating strike button toward the plunger.

Example 16 can include, or can optionally be combined with the subject matter of Examples 1-15 to optionally include a biasing element coupled with at least one of the latch blade or the operator interface feature, the biasing element configured to bias the latch blade toward the deployed position and the operator interface feature toward the locked configuration.

Example 17 can include, or can optionally be combined with the subject matter of Examples 1-16 to optionally include wherein the biasing element is coupled with the operator interface feature.

Example 18 can include, or can optionally be combined with the subject matter of Examples 1-17 to optionally include a fenestration assembly comprising: a fenestration frame including at least one latch bolt recess; first and second sashes coupled within the fenestration frame, at least one of the first and second sashes is slidable within the fenestration frame; the first sash includes: an operator assembly including an operator interface feature and a latch blade coupled with the operator interface feature, the latch blade having deployed and withdrawn positions, and at least one latch bolt assembly including a latch bolt configured for reception within the latch bolt recess; the second sash includes a blade socket, the blade socket includes a blade recess configured to receive the latch blade in the deployed position; and wherein the operation assembly includes locked, unlocked and tilting configurations: in the locked configuration the operator interface feature is in a locked position, and the latch blade is in the deployed position within the blade recess of the second sash to prevent opening of either of the first or second sashes, in the unlocked configuration the operator interface feature is in an unlocked position, and the latch blade is in the withdrawn position of the first sash and recessed from the blade recess of the second sash to allow opening of one or more of the first or second sashes, and in the tilting configuration the operator interface feature is in a tilting position and the latch bolt is withdrawn from the latch bolt groove to allow tilting of at least the first sash relative to the fenestration frame.

Example 19 can include, or can optionally be combined with the subject matter of Examples 1-18 to optionally include wherein the operator interface feature is rotatably coupled with the first sash, and the latch blade is translationally coupled with the first sash and configured for reciprocating movement between the withdrawn and deployed positions.

Example 20 can include, or can optionally be combined with the subject matter of Examples 1-19 to optionally include wherein the operator interface feature includes an eccentric cam spaced from a rotational axis of the operator interface feature, and the latch blade includes a cam follower coupled with the eccentric cam.

Example 21 can include, or can optionally be combined with the subject matter of Examples 1-20 to optionally include wherein the latch blade and the operator interface feature are remote from stiles of the first sash.

Example 22 can include, or can optionally be combined with the subject matter of Examples 1-21 to optionally include wherein the latch blade and the operator interface feature are within an interior portion of a sash check rail spaced from stiles of the first sash.

Example 23 can include, or can optionally be combined with the subject matter of Examples 1-22 to optionally include a retaining mechanism, in the unlocked configuration the retaining mechanism is configured to retain the operator interface feature in the unlocked position and the latch blade in the withdrawn position.

Example 24 can include, or can optionally be combined with the subject matter of Examples 1-23 to optionally include a release assembly coupled with the first sash, the release assembly is configured to disengage the retaining mechanism and release both the latch blade to move into the deployed position within the blade recess and the operator interface feature to return to the locked position with closing of the first and second sashes.

Example 25 can include, or can optionally be combined with the subject matter of Examples 1-24 to optionally include wherein the release assembly includes a biasing element coupled with at least one of the latch blade or the operator interface feature, the biasing element configured to bias the latch blade toward the deployed position and the operator interface feature toward the locked position.

Example 26 can include, or can optionally be combined with the subject matter of Examples 1-25 to optionally include wherein the biasing element is coupled with the latch blade.

Example 27 can include, or can optionally be combined with the subject matter of Examples 1-26 to optionally include a method for using a fenestration assembly comprising: unlocking first and second sashes for sliding movement within a fenestration frame, unlocking includes: rotating an operator interface feature from a locked position to an unlocked position at a first sash, translating a latch blade from a deployed position within a blade recess of a second sash to a withdrawn position within the first sash, and retaining the operator interface feature in the unlocked position and the latch blade in the withdrawn position with a retaining mechanism; sliding one or both of the first or second sashes in any order into open positions; sliding one or both of the first or second sashes in the open positions to closed positions; and automatically locking the first and second sashes with the latch blade at the closed positions, automatically locking includes: engaging a release assembly against one of the first or second sashes with sliding to the closed positions, disengaging the retaining mechanism from the operator interface feature with movement of the release assembly, and rotating the operator interface feature form the unlocked position to the locked position and translating the latch blade from the withdrawn position to the deployed position within the blade recess.

Example 28 can include, or can optionally be combined with the subject matter of Examples 1-27 to optionally include wherein retaining the operator interface feature includes biasing a detent of a detent element into one or more detent notches of the operator interface feature.

Example 29 can include, or can optionally be combined with the subject matter of Examples 1-28 to optionally include wherein disengaging the retaining mechanism with movement of the release assembly includes: moving a plunger of the release assembly through engagement with one of the first or second sashes, moving a release element of the release assembly according to movement of the plunger, and moving the detent out of the one or more detent notches according to movement of the release element.

Example 30 can include, or can optionally be combined with the subject matter of Examples 1-29 to optionally include wherein sliding one or both of the first or second sashes includes deploying a plunger of the release assembly from the first sash according to sliding movement of one of the first or second sashes relative to the other of the second or first sashes.

Example 31 can include, or can optionally be combined with the subject matter of Examples 1-30 to optionally include wherein deploying the plunger includes aligning the plunger with a release element of the release assembly.

Example 32 can include, or can optionally be combined with the subject matter of Examples 1-31 to optionally include wherein sliding one or both of the first and second sashes in the open positions to closed positions and engaging the release assembly against one of the first or second sashes includes depressing the plunger with the second sash and moving the release element aligned with the depressed plunger.

Example 33 can include, or can optionally be combined with the subject matter of Examples 1-32 to optionally include wherein sliding one or both of the first or second sashes in the open positions to closed positions and disengaging the retaining mechanism from the operator interface feature includes moving a detent element with the moved release element and unseating a detent of the detent element from one or more detent notches.

Example 34 can include, or can optionally be combined with the subject matter of Examples 1-33 to optionally include transitioning at least one of the first or second sashes to a tilting configuration including: rotating the operator interface feature from the unlocked position to a tilting position, wrapping a tying element around a portion of the operator interface feature, withdrawing one or more latch bolts from one or more latch bolt recesses of a fenestration frame according to wrapping of the tying element, and tilting one of the first or second sashes relative to the fenestration frame.

Example 35 can include, or can optionally be combined with the subject matter of Examples 1-34 to optionally include wherein the operator interface feature includes a spool having a wrapping zone, and wrapping the tying element includes wrapping the tying element around the spool while the spool is rotated within the wrapping zone.

Example 36 can include, or can optionally be combined with the subject matter of Examples 1-35 to optionally include wherein the spool includes a passive zone, and rotating the operator interface feature from the locked position to the unlocked position includes maintaining the tying element in an unwound configuration while the spool is rotated within the passive zone.

Example 37 can include, or can optionally be combined with the subject matter of Examples 1-36 to optionally include wherein rotating the operator interface feature from the unlocked position to the locked position and translating the latch blade from the withdrawn position to the deployed position within the blade recess includes rotating and translating with a biasing element coupled with at least one of the latch blade or the operator interface feature.

Example 38 can include, or can optionally be combined with the subject matter of Examples 1-37 to optionally include wherein rotating the operator interface feature form the unlocked position to the locked position and translating the latch blade from the withdrawn position to the deployed position within the blade recess includes rotating and translating with an operator biasing element coupled with the operator interface feature.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

The claimed invention is:

1. A fenestration hardware assembly comprising:

a blade socket including a blade recess;

an operator interface feature rotatably coupled with an operator housing;

a latch blade movably coupled with a spindle, wherein the spindle rotatably couples the operator interface feature with the latch blade such that the latch blade is translationally movable between deployed and withdrawn positions according to rotation of the spindle and the operator interface feature;

in the deployed position, the at least a portion of the latch blade is received in the blade recess of the blade socket; and in the withdrawn position, the at least a portion of the latch blade is withdrawn;

wherein the operator interface feature includes a rotation axis and an eccentric cam spaced from the rotation axis;

the latch blade includes a cam follower coupled with the eccentric cam; and wherein the operator interface feature is rotatable with the spindle between at least locked and unlocked configurations:

in the locked configuration the latch blade is in the deployed position and at least the portion of the latch blade is received in the blade recess; and in the unlocked configuration, the latch blade is translationally movable from the deployed position to the withdrawn position and the portion of the latch blade is withdrawn from the blade recess according to rotation of the operator interface feature.

2. The assembly of claim 1, wherein the latch blade is configured for reciprocating translational movement between the withdrawn and deployed positions.

3. The assembly of claim 1, wherein the eccentric cam includes a pin, and the cam follower includes a slot, the pin received within the slot.

4. The assembly of claim 1, wherein the eccentric cam includes a pin having an active face and a passive face;

the active face is configured to engage with the cam follower and translate the latch blade from the deployed position toward the withdrawn position; and the passive face is configured for recessing from the cam follower and maintaining the latch blade in the withdrawn position.

5. The assembly of claim 1, wherein the latch blade is configured for coupling with a first sash at a first location remote from edges of the sash configured for sliding movement along a fenestration frame; and the blade socket is configured for coupling with a second sash at a second location opposed to the first location.

6. The assembly of claim 5 further comprising the first and second sashes, the latch blade is coupled with the first sash near a midpoint of a first sash check rail, and the blade socket is coupled with the second sash near a midpoint of a second sash bottom rail.

7. The assembly of claim 1 further comprising:

at least one latch bolt assembly having a latch bolt movable between a withdrawn tilting position and a deployed static position;

a tying element coupled between the latch bolt and the operator interface feature; and wherein the operator interface feature is rotatable between the unlocked configuration and a tilting configuration, and in the tilting configuration the latch bolt is in the withdrawn tilting position according to rotation of the operator interface feature toward the tilting configuration.

8. The assembly of claim 7, wherein the operator interface feature includes a spool having passive and wrapping zone;

in the passive zone, the spool is disengaged from the tying element with rotation of the operator interface feature between locked and unlocked configurations; and in the wrapping zone, the spool is engaged with the tying element and rotation of the operator interface feature from the unlocked configuration toward the tilting configuration wraps the tying element around the spool.

9. The assembly of claim 1 further comprising a retaining mechanism configured to retain the operator interface feature in the unlocked configuration and the latch blade in the withdrawn position.

10. The assembly of claim 9, wherein the retaining mechanism includes:

one or more detent notches coupled with the operator interface feature; and a detent element movably coupled with the operator housing, the detent element is biased toward the one or more detent notches, and reception of the detent element in the one or more detent notches retains the operator interface feature in the unlocked configuration and the latch blade in the withdrawn position.

11. The assembly of claim 9 further comprising a release assembly coupled with the operator housing, the release assembly is configured to disengage the retaining mechanism and release both the latch blade, to translationally move into the deployed position, and the operator interface feature, to return to the locked configuration, with closing of first and second sashes.

12. The assembly of claim 11, wherein the release assembly includes:

a plunger movably coupled with the operator housing;

a release element coupled with the retaining mechanism; and the plunger is configured to move the release element with the closing of the first and second sashes, such that the movement of the release element causes the detent element of the retaining mechanism to disengage from the one or more detent notches.

13. The assembly of claim 12, wherein the operator interface feature includes a reset boss configured to bias the release element out of alignment with the plunger and reengage the detent element of the retaining mechanism with the one or more notches coupled with the operator interface feature with return of the operator interface feature to the locked configuration.

14. The assembly of claim 12, wherein the release assembly further includes:

a floating strike button coupled with the blade socket; and a strike biasing element configured to bias the floating strike button toward the plunger.

15. The assembly of claim 1 further comprising a biasing element coupled with at least one of the latch blade and the operator interface feature, the biasing element configured to bias the latch blade toward the deployed position and the operator interface feature toward the locked configuration.

16. The assembly of claim 15, wherein the biasing element is coupled with the operator interface feature.

17. A fenestration assembly comprising:

a fenestration frame including at least one latch bolt recess;

first and second sashes coupled within the fenestration frame, at least one of the first and second sashes is slidable within the fenestration frame;

the first sash includes:

an operator assembly including an operator interface feature and a latch blade coupled with the operator interface feature, the latch blade having deployed and withdrawn positions;

the operator interface feature is rotatably coupled with the first sash, and the latch blade is translationally coupled with the first sash and configured for reciprocating translational movement between the withdrawn and deployed positions; and at least one latch bolt assembly including a latch bolt configured for reception within the at least one latch bolt recess;

the second sash includes a blade socket, the blade socket includes a blade recess configured to receive the latch blade in the deployed position; and wherein the operator assembly includes locked, unlocked, and tilting configurations:

in the locked configuration the operator interface feature is in a locked position, and the latch blade is in the deployed position within the blade recess of the second sash to prevent opening of either of the first or second sashes;

in the unlocked configuration the operator interface feature is in an unlocked position, and the latch blade is in the withdrawn position relative to the first sash and recessed from the blade recess of the second sash to allow opening of one or more of the first or second sash; and in the tilting configuration the operator interface feature is in a tilting position and the latch bolt is withdrawn from the latch bolt groove to allow tilting of at least the first sash relative to the fenestration frame.

18. The assembly of claim 17, wherein the operator interface feature includes an eccentric cam spaced from a rotational axis of the operator interface feature; and the latch blade includes a cam follower coupled with the eccentric cam.

19. The assembly of claim 17, wherein the latch blade and the operator interface feature are remote from stiles of the first sash.

20. The assembly of claim 17, wherein the latch blade and the operator interface feature are within an interior portion of a sash check rail spaced from stiles of the first sash.

21. The fenestration assembly of claim 17 further comprising a retaining mechanism, in the unlocked configuration, the retaining mechanism is configured to retain the operator interface feature in the unlocked position and the latch blade in the withdrawn position.

22. The fenestration assembly of claim 21 further comprising a release assembly coupled with the first sash, the release assembly is configured to disengage the retaining mechanism and release both the latch blade, to translationally move into the deployed position within the blade recess, and the operator interface feature, to return to the locked position, with closing of one or more of the first and second sashes.

23. The fenestration assembly of claim 22, wherein the release assembly includes a biasing element coupled with at least one of the latch blade and the operator interface feature, the biasing element configured to bias the latch blade toward the deployed position and the operator interface feature toward the locked position.

24. The assembly of claim 23, wherein the biasing element is coupled with the latch blade.

25. A method for using a fenestration assembly comprising:

unlocking first and second sashes for sliding movement within a fenestration frame, the unlocking includes:

rotating an operator interface feature, coupled with a spindle and an eccentric cam, from a locked position to an unlocked position at the first sash;

translating a latch blade including a cam follower, coupled with the spindle and the eccentric cam, from a deployed position within a blade recess of the second sash to a withdrawn position within the first sash;

wherein the translation of the latch blade is transverse to a rotation of the spindle;

retaining the operator interface feature in the unlocked position and the latch blade in the withdrawn position with a retaining mechanism;

sliding one or both of the first and second sashes in any order into open positions;

sliding one or both of the first and second sashes in the open positions to closed positions; and automatically locking the first and second sashes with the latch blade at the closed positions of the one or both of the first and second sashes, the automatically locking includes:

engaging a release assembly against one of the first and second sashes with sliding of the one or both of the first and second sashes to the closed positions;

disengaging the retaining mechanism from the operator interface feature with movement of the release assembly; and rotating the operator interface feature from the unlocked position to the locked position and translating the latch blade from the withdrawn position to the deployed position within the blade recess.

26. The method of claim 25, wherein the step of retaining the operator interface feature includes biasing a detent of a detent element of the retaining mechanism into one or more detent notches of the retaining mechanism of the operator interface feature.

27. The method of claim 26, wherein the step of disengaging the retaining mechanism with movement of the release assembly includes:

moving a plunger of the release assembly through engagement of the plunger with one of the first and second sashes;

moving a release element of the release assembly according to the movement of the plunger; and moving the detent out of the one or more detent notches according to the movement of the release element.

28. The method of claim 25, wherein the step of sliding one or both of the first and second sashes includes deploying a plunger of the release assembly from the first sash according to sliding movement of one of the first and second sashes relative to the other of the second and first sashes.

29. The method of claim 28, wherein the step of deploying the plunger includes aligning the plunger with a release element of the release assembly.

30. The method of claim 29, wherein the step of sliding one or both of the first and second sashes in the open positions to closed positions and engaging the release assembly against the one of the first or second sashes includes depressing the plunger with the second sash and moving the release element out of alignment with the depressed plunger as the plunger is depressed.

31. The method of claim 30, wherein the step of sliding one or both of the first and second sashes in the open positions to closed positions and disengaging the retaining mechanism from the operator interface feature includes moving a detent element by the movement of the release element and unseating a detent of the detent element from one or more detent notches.

32. The method of claim 25 further comprising transitioning the first sash to a tilting configuration including:

rotating the operator interface feature from the unlocked position to a tilting position;

during which a tying element is wrapped around a portion of the operator interface feature;

withdrawing one or more latch bolts from one or more latch bolt recesses of a fenestration frame according to the wrapping of the tying element; and tilting the first sash relative to the fenestration frame.

33. The method of claim 32, wherein the operator interface feature includes a spool having a wrapping zone, and the wrapping of the tying element includes wrapping the tying element around the spool while the spool is rotated within the wrapping zone.

34. The method of claim 33, wherein the spool includes a passive zone, and the rotating of the operator interface feature from the locked position to the unlocked position includes maintaining the tying element in an unwound configuration while the spool is rotated within the passive zone.

35. The method of claim 25, wherein the rotating of the operator interface feature from the unlocked position to the locked position, such that the latch blade is translated from the withdrawn position to the deployed position within the blade recess includes rotating the operator interface feature with a biasing element coupled with at least one of the latch blade and the operator interface feature.

36. The method of claim 25, wherein the rotating of the operator interface feature from the unlocked position to the locked position, such that the latch blade is translated from the withdrawn position to the deployed position within the blade recess includes rotating the operator interface feature with an operator biasing element coupled with the operator interface feature.

* * * * *